US012339019B2

(12) United States Patent
Watanabe et al.

(10) Patent No.: US 12,339,019 B2
(45) Date of Patent: Jun. 24, 2025

(54) AIR-CONDITIONING DEVICE

(71) Applicant: Mitsubishi Electric Corporation, Tokyo (JP)

(72) Inventors: Kazuya Watanabe, Tokyo (JP); Mizuo Sakai, Tokyo (JP); Ryosuke Okazawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 121 days.

(21) Appl. No.: 18/251,778

(22) PCT Filed: Feb. 12, 2021

(86) PCT No.: PCT/JP2021/005332
§ 371 (c)(1),
(2) Date: May 4, 2023

(87) PCT Pub. No.: WO2022/172410
PCT Pub. Date: Aug. 18, 2022

(65) Prior Publication Data

US 2023/0408122 A1 Dec. 21, 2023

(51) Int. Cl.
*F24F 11/41* (2018.01)
*F24F 11/49* (2018.01)
*F24F 140/20* (2018.01)

(52) U.S. Cl.
CPC ..... *F24F 11/41* (2018.01); *F24F 11/49* (2018.01); *F24F 2140/20* (2018.01)

(58) Field of Classification Search
CPC .. F24F 11/41; F24F 11/49; F24F 11/81; F24F 2140/20; F24F 2012/007; F25B 13/00;
(Continued)

(56) References Cited

U.S. PATENT DOCUMENTS 12,264,847 B2 * 4/2025 Tamaki ..... F24H 15/104
2011/0232308 A1 * 9/2011 Morimoto ..... F25B 13/00 62/278

(Continued)

FOREIGN PATENT DOCUMENTS

JP H04-288464 A 10/1992
JP 2002-349927 A 12/2002

(Continued)

OTHER PUBLICATIONS

International Search Report of the International Searching Authority mailed Mar. 30, 2021 in corresponding International Application No. PCT/JP2021/005332 (and English translation).

(Continued)

*Primary Examiner* — Miguel A Diaz
(74) *Attorney, Agent, or Firm* — Posz Law Group, PLC

(57) ABSTRACT

An air-conditioning device includes a main circuit in which a refrigerant circulates; a flow channel-switching unit that selects a certain parallel heat exchanger as a defrosting target; a bypass pipe; a temperature-detecting unit; and one or more processors. The processor(s) operates the flow channel-switching unit such that an operation mode is switched between a normal heating operation mode in which the parallel heat exchangers serve as evaporators and a defrosting heating operation mode in which one parallel heat exchanger is selected as the defrosting target to cause part of the refrigerant to flow thereinto via the bypass pipe and the other parallel heat exchangers serves as an evaporator. The processor(s) senses erroneous installation of an installed component based on a magnitude relationship between the detected temperatures in the parallel heat exchangers detected by the temperature-detecting unit.

12 Claims, 15 Drawing Sheets

(58) Field of Classification Search
CPC .... F25B 2313/0232; F25B 2313/02322; F25B 2313/0252; F25B 2313/02522; F25B 2400/04; F25B 2700/2101; F25B 47/02; F25B 47/022; F25B 2347/02; F25B 2347/021
See application file for complete search history.

(56) References Cited

U.S. PATENT DOCUMENTS

| | | | | |
|---|---|---|---|---|
| 2015/0292789 | A1 | 10/2015 | Takenaka et al. | |
| 2018/0266743 | A1* | 9/2018 | Watanabe | F25B 47/02 |
| 2021/0348789 | A1 | 11/2021 | Fukui et al. | |
| 2022/0154966 | A1 | 5/2022 | Watanabe et al. | |

FOREIGN PATENT DOCUMENTS

| | | | |
|---|---|---|---|
| JP | 2008-157558 | A | 7/2008 |
| JP | 6594599 | B1 | 10/2019 |
| WO | 2014/083867 | A1 | 6/2014 |
| WO | 2020/121411 | A1 | 6/2020 |

OTHER PUBLICATIONS

Office Action mailed Apr. 2, 2024 in corresponding Japanese Patent Application No. 2022-581124 (and English machine translation).

* cited by examiner

FIG. 3

| DEVICE NAME | COOLING OPERATION | HEATING OPERATION | | |
|---|---|---|---|---|
| | | NORMAL HEATING OPERATION | DEFROSTING HEATING OPERATION | |
| | | | PATH 1-SIDE DEFROSTING | PATH 2-SIDE DEFROSTING |
| COOLING/HEATING-SWITCHING UNIT 12 | SWITCHING A | SWITCHING B | SWITCHING B | SWITCHING B |
| FIRST ON/OFF-SWITCHING DEVICE 41-1 | ON | ON | OFF | ON |
| FIRST ON/OFF-SWITCHING DEVICE 41-2 | ON | ON | ON | OFF |
| SECOND ON/OFF-SWITCHING DEVICE 42-1 | OFF | OFF | ON | OFF |
| SECOND ON/OFF-SWITCHING DEVICE 42-2 | OFF | OFF | OFF | ON |

FIG. 15

| DEVICE NAME | COOLING OPERATION | HEATING OPERATION | | |
|---|---|---|---|---|
| | | NORMAL HEATING OPERATION | DEFROSTING HEATING OPERATION | |
| | | | PATH 1-SIDE DEFROSTING | PATH 2-SIDE DEFROSTING |
| COOLING/HEATING-SWITCHING UNIT 12 | SWITCHING A | SWITCHING B | SWITCHING B | SWITCHING B |
| SWITCHING DEVICE 43-1 | MAIN CIRCUIT | MAIN CIRCUIT | BYPASS | MAIN CIRCUIT |
| SWITCHING DEVICE 43-2 | MAIN CIRCUIT | MAIN CIRCUIT | MAIN CIRCUIT | BYPASS |

AIR-CONDITIONING DEVICE

CROSS REFERENCE TO RELATED APPLICATION

This application is a U.S. national stage application of International Application No. PCT/JP2021/005332, filed on Feb. 12, 2021, the contents of which are incorporated herein by reference.

TECHNICAL FIELD

The present disclosure relates to an air-conditioning device.

BACKGROUND

Recently, heat pump type air-conditioning devices using air as a heat source have more often been installed instead of boiler type heating mechanisms that perform heating by burning fossil fuel in cold regions in view of global environmental conservation. A heat pump type air-conditioning device can efficiently perform heating with supply of heat from air in addition to supply of electric power to a compressor.

However, in such a heat pump type air-conditioning device, as the temperature of the outside air or the like becomes lower, frost is more likely to be attached to an outdoor heat exchanger serving as an evaporator and exchanging heat between outside air and a refrigerant. Accordingly, such a heat pump type air-conditioning device needs to perform defrosting by melting frost attached to the outdoor heat exchanger. As such a defrosting method, for example, a method of reversing the flow of a refrigerant in a heating mechanism and supplying the refrigerant from the compressor to the outdoor heat exchanger is known. In this method, since indoor heating stops while defrosting is being performed, comfort may be compromised.

Therefore, an air-conditioning device that can perform heating in a period of defrosting in which the outdoor heat exchanger are partitioned, defrosting is performed on some of the partitioned outdoor heat exchangers and the other partitioned outdoor heat exchangers are operated as evaporators to perform heating is proposed (for example, see Patent Document 1 and Patent Document 2).

In the aforementioned air-conditioning device according to the related art, the outdoor heat exchanger is partitioned into a plurality of parallel heat exchangers and a flow channel-switching unit such as a switching valve that switches a heat exchanger such that it operates as an evaporator or performs defrosting is provided. The air-conditioning device according to the related art performs defrosting without stopping heating by causing part of a refrigerant emitted from the compressor to flow into the heat exchanger having requested defrosting and to perform defrosting using the flow channel-switching unit.

PATENT DOCUMENT

Patent Document 1

Japanese Unexamined Patent Application, First Publication No. 2008-157558

Patent Document 2

PCT International Publication No. WO2014/083867

However, for example, when the flow channel-switching unit is erroneously connected and attached to a heat exchanger other than a heat exchanger to which the flow channel-switching unit should be connected and attached, the air-conditioning device according to the related art may not sense erroneous installation of an installed component such as the flow channel-switching unit and may not perform defrosting normally.

SUMMARY

The present disclosure was invented to solve the aforementioned problem and an objective thereof is to provide an air-conditioning device that can sense erroneous installation of an installed component and perform defrosting normally without stopping heating of an indoor unit.

In order to achieve the aforementioned objective, according to an aspect of the present disclosure, an air-conditioning device is provided, including: a main circuit in which a compressor, an indoor heat exchanger, a decompressor, and a plurality of parallel heat exchangers connected in parallel are connected by a pipe and in which a refrigerant circulates; a flow channel-switching unit connected to the plurality of parallel heat exchangers and configured to select a certain parallel heat exchanger out of the plurality of parallel heat exchangers as a defrosting target for defrosting by melting frost attached to the parallel heat exchanger; a bypass pipe configured to cause part of a refrigerant emitted from the compressor to flow into the parallel heat exchanger selected as the defrosting target by the flow channel-switching unit; a temperature-detecting unit configured to detect temperatures of the refrigerant in the plurality of parallel heat exchangers; an operation control unit configured to operate the flow channel-switching unit such that an operation mode is switched between a normal heating operation mode in which the plurality of parallel heat exchangers serve as evaporators and a defrosting heating operation mode in which one parallel heat exchanger out of the plurality of parallel heat exchangers is selected as the defrosting target to cause part of the refrigerant to flow thereinto via the bypass pipe and the other parallel heat exchangers serves as an evaporator; and an erroneous installation-sensing unit configured to sense erroneous installation of an installed component associated with the defrosting based on a magnitude relationship between the detected temperatures in the plurality of parallel heat exchangers detected by the temperature-detecting unit.

According to the present disclosure, it is possible to sense erroneous installation of an installed component associated with defrosting and to perform defrosting normally without stopping heating of an indoor unit.

BRIEF DESCRIPTION OF DRAWINGS

FIG. 3 is a drawing illustrating states of a cooling/heating-switching unit and a flow channel-switching unit corresponding to an operation mode of the air-conditioning device according to the first embodiment.

FIG. 15 is a drawing illustrating states of a cooling/heating-switching unit and a switching device corresponding to an operation mode of the air-conditioning device according to the third embodiment.

DETAILED DESCRIPTION

Hereinafter, an air-conditioning device according to embodiments of the present disclosure are described with reference to the accompanying drawings.

First Embodiment

Figure 1:
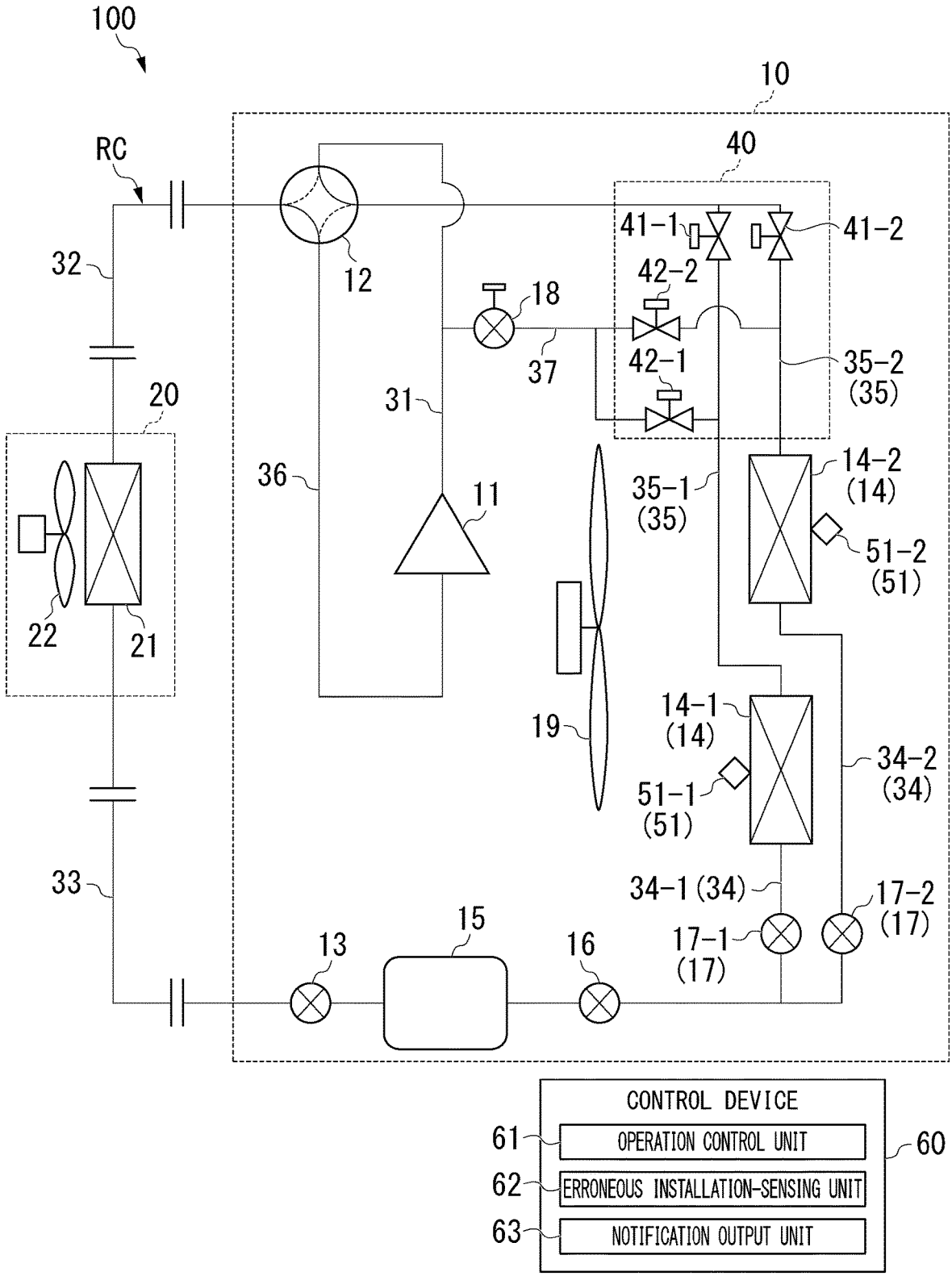
FIG. 1 is a drawing illustrating an example of a configuration of an air-conditioning device according to a first embodiment.

FIG. 1 is a drawing illustrating an example of a configuration of an air-conditioning device 100 according to a first embodiment of the present disclosure.

As illustrated in FIG. 1, the air-conditioning device 100 includes an outdoor unit 10, an indoor unit 20, and a control device 60.

The outdoor unit 10 is a heat source unit that generates heat which is supplied to the indoor unit 20 and serves as a heat source-side unit.

The indoor unit 20 serves as a load-side unit that uses heat supplied from the outdoor unit 10. The indoor unit 20 includes an indoor heat exchanger 21 and an indoor fan 22.

The outdoor unit 10 and the indoor unit 20 are connected to each other by a first extension pipe 32 and a second extension pipe 33.

The indoor heat exchanger 21 performs exchange of heat with indoor air using heat supplied from the outdoor unit 10.

The indoor fan 22 carries indoor air to the indoor heat exchanger 21. That is, the indoor fan 22 is an air blower that blows indoor air to the indoor heat exchanger 21.

The outdoor unit 10 includes a compressor 11, a cooling/heating-switching unit 12, a first decompressor 13, a plurality of parallel heat exchangers 14 (14-1 and 14-2), a receiver 15, a third decompressor 16, a plurality of second decompressors 17 (17-1 and 17-2), a flow rate-adjusting device 18, an outdoor fan 19, a flow channel-switching unit and a plurality of temperature-detecting units 51 (51-1 and 51-2).

The air-conditioning device 100 includes a main circuit RC which is a refrigerant circuit for circulating a refrigerant between the outdoor unit 10 and the indoor unit 20.

The main circuit RC has a configuration in which the constituents of the main circuit RC included in the outdoor unit 10 and the indoor unit 20 are connected by an emission pipe 31, a first extension pipe 32, a second extension pipe 33, a first connection pipe 34, a second connection pipe 35, and an intake pipe 36.

The refrigerant used for the main circuit RC is, for example, a Freon refrigerant or a hydrofluoroolefin refrigerant (an HFO refrigerant). Examples of the Freon refrigerant include an R32 refrigerant, an R125 refrigerant and an R134a refrigerant, which are chlorofluorocarbon-based refrigerants (HFC-based refrigerants), and an R410A refrigerant, an R407c refrigerant and an R404A refrigerant, which are mixed refrigerants thereof. Examples of the HFO refrigerant include HFO-1234yf, HFO-1234 ze(E) and HFO-1234 ze(Z).

The main circuit RC has a configuration in which the compressor 11, the cooling/heating-switching unit 12, the indoor heat exchanger 21, the first decompressor 13, the parallel heat exchanger 14-1, and the parallel heat exchanger 14-2 are sequentially connected by a pipe.

The compressor 11 is connected between the intake pipe 36 and the emission pipe 31. The compressor 11 compresses a refrigerant supplied via the intake pipe 36 and emits a high-temperature high-pressure refrigerant to the emission pipe 31.

The cooling/heating-switching unit 12 is connected between the emission pipe 31 and the intake pipe 36 and switches a flow direction of the refrigerant. The cooling/heating-switching unit 12 is constituted, for example, by a four-way valve. The emission side of the compressor 11 and the cooling/heating-switching unit 12 are connected by the emission pipe 31. The intake side of the compressor 11 and the cooling/heating-switching unit 12 are connected by the intake pipe 36.

In a heating operation, the cooling/heating-switching unit 12 connects the emission pipe 31 and the first extension pipe 32, connects the emission side of the compressor 11 and the indoor heat exchanger 21, connects the intake pipe 36 and the second connection pipes 35 (35-1, 35-2), and connects the intake side of the compressor 11 and the parallel heat exchangers 14 (14-1, 14-2).

In a cooling operation, the cooling/heating-switching unit 12 connects the emission pipe 31 and the second connection pipes 35 (35-1, 35-2), connects the emission side of the compressor 11 and the parallel heat exchangers 14 (14-1, 14-2), connects the intake pipe 36 and the first connection pipe 32, and connects the intake side of the compressor 11 and the indoor heat exchanger 21.

In this embodiment, the switching state of the cooling/heating-switching unit 12 in the cooling operation is referred to as switching A, and the switching state of the cooling/heating-switching unit 12 in the heating operation is referred to as switching B.

The first decompressor 13 is connected to the indoor heat exchanger 21 by the second extension pipe 33 and decompresses and expands the refrigerant.

The receiver 15 is disposed between the first decompressor 13 and the third decompressor 16 and is a tank in which a liquid refrigerant is stored.

The plurality of parallel heat exchangers 14 (14-1 and 14-2) are disposed in parallel between the cooling/heating-switching unit 12 and the second decompressors 17 (17-1, 17-2) and are, for example, outdoor heat exchangers that perform exchange of heat between outside air and the refrigerant.

In this embodiment, the parallel heat exchanger 14-1 and the parallel heat exchanger 14-2 are referred to as parallel heat exchangers 14 when they indicate arbitrary parallel heat exchangers of the air-conditioning device 100 or when they are not particularly distinguished.

The parallel heat exchanger 14-1 is connected between the first connection pipe 34-1 and the second connection pipe 35-1. The parallel heat exchanger 14-2 is connected between the first connection pipe 34-2 and the second connection pipe 35-2.

In this embodiment, the first connection pipe 34-1 and the first connection pipe 34-2 are referred to as first connection pipes 34 when they indicate arbitrary first connection pipes of the air-conditioning device 100 or when they are not particularly distinguished. In this embodiment, the second connection pipe 35-1 and the second connection pipe 35-2 are referred to as second connection pipes 35 when they indicate arbitrary second connection pipes of the air-conditioning device 100 or when they are not particularly distinguished.

A detailed configuration of the parallel heat exchanger 14 (14-1, 14-2) are described below with reference to FIG. 2.

Figure 2:
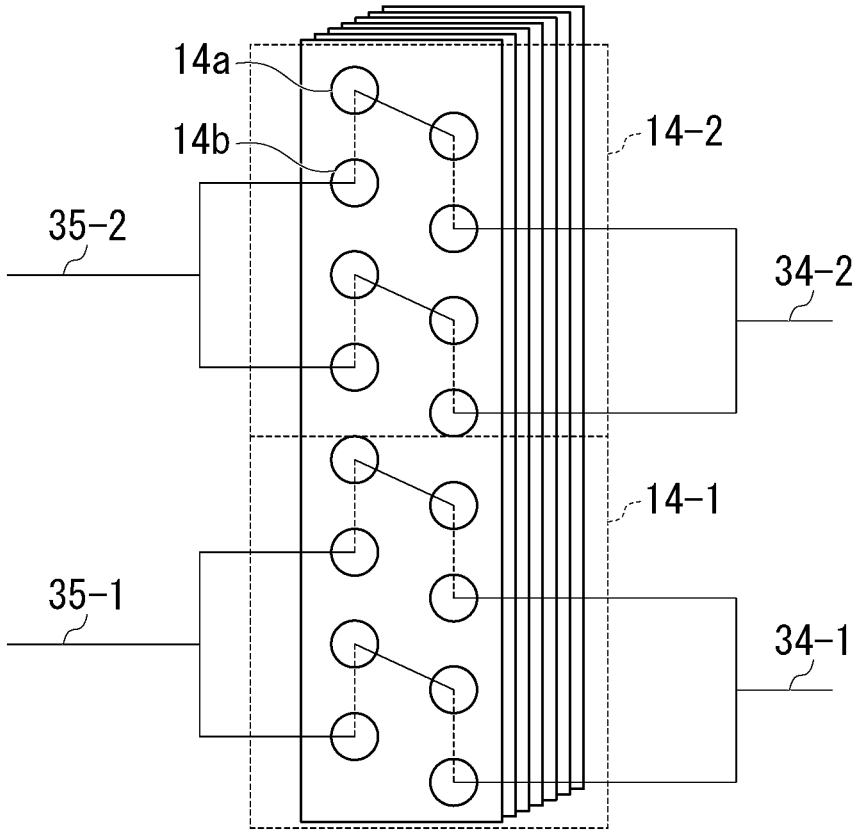
FIG. 2 is a drawing illustrating an example of a configuration of a parallel heat exchanger according to the first embodiment.

FIG. 2 is a drawing illustrating an example of a configuration of the parallel heat exchanger 14 (14-1, 14-2) according to this embodiment.

As illustrated in FIG. 2, the parallel heat exchanger 14 (14-1, 14-2) is constituted, for example, as a finned tube type heat exchanger including a plurality of heat transfer tubes 14*a* and a plurality of fins 14*b*. Here, it is assumed that the outdoor heat exchanger is divided into two parallel heat exchangers 14 (14-1, 14-2).

A plurality of heat transfer tubes 14*a* through which a refrigerant passes therein are provided in a stepped direction perpendicular to an air-passing direction and provided in a column direction parallel to the air-passing direction.

The fins 14*b* are disposed at intervals such that air passes in the air-passing direction. The fins 14*b* may have an integral shape which is not divided into the parallel heat exchanger 14-1 and the parallel heat exchanger 14-2 or may be divided into the parallel heat exchanger 14-1 and the parallel heat exchanger 14-2 as illustrated in FIG. 2.

The parallel heat exchangers 14 (14-1, 14-2) are divided in the up-and-down direction in a casing of the outdoor unit 10. The parallel heat exchangers 14 may be divided in a left-and-right direction or may be divided in the up-and-down direction as illustrated in FIG. 2. When the parallel heat exchanger 14 is divided in the left-and-right direction, refrigerant inlets to the parallel heat exchanger 14-1 and the parallel heat exchanger 14-2 are located at both ends in the left-and-right direction of the outdoor unit 10 and thus pipe connection of the parallel heat exchangers 14 is complicated, but water generated through defrosting does not become attached to the other heat exchangers.

When the parallel heat exchanger 14 is divided in the up-and-down direction, pipe connection is facilitated, but water generated from the upper heat exchanger flows down to the lower heat exchanger and thus there is a likelihood that heat exchange may be inhibited because water generated through defrosting in the upper heat exchanger becomes frozen in the lower heat exchanger when the lower heat exchanger serves as an evaporator while defrosting of the upper heat exchanger is being performed.

Referring back to FIG. 1, the third decompressor 16 is disposed between the receiver 15 and two parallel heat exchangers 14 (14-1, 14-2). The third decompressor 16 decompresses and expands a refrigerant.

The second decompressors 17 (17-1, 17-2) are disposed between the parallel heat exchangers 14 (14-1, 14-2) and the third decompressor 16 and decompress and expand the refrigerant. The second decompressor 17-1 is connected to the parallel heat exchanger 14-1 via the first connection pipe 34-1. The second decompressor 17-2 is connected to the parallel heat exchanger 14-2 via the first connection pipe 34-2. The second decompressor 17 may be configured to only decompress a refrigerant and thus may be a capillary tube, an expansion valve, or the like.

In this embodiment, the second decompressor 17-1 and the second decompressor 17-2 are referred to as second decompressors 17 when they indicate arbitrary second decompressors of the air-conditioning device 100 or when they are not particularly distinguished.

The flow channel-switching unit 40 is connected to the two parallel heat exchangers 14 and selects one parallel heat exchanger 14 of the two parallel heat exchangers 14 as a defrosting target. Here, a defrosting target is a target to be defrosted such that frost attached to the parallel heat exchanger 14 is melted. The flow channel-switching unit 40 is disposed in the second connection pipes 35 (35-1, 35-2) between the emission side of the compressor 11 (the cooling/heating-switching unit 12) and the two parallel heat exchangers 14 (14-1, 14-2).

The flow channel-switching unit 40 includes a first on/off-switching device 41-1, a first on/off-switching device 41-2, a second on/off-switching device 42-1, and a second on/off-switching device 42-2.

The first on/off-switching device 41-1 is disposed between the cooling/heating-switching unit 12 and the second connection pipe 35-1. The first on/off-switching device 41-1 is, for example, an on/off valve and connects or disconnects a flow channel between the cooling/heating-switching unit 12 and the second connection pipe 35-1.

The first on/off-switching device 41-2 is disposed between the cooling/heating-switching unit 12 and the second connection pipe 35-2. The first on/off-switching device 41-1 is, for example, an on/off valve and connects or disconnects a flow channel between the cooling/heating-switching unit 12 and the second connection pipe 35-2.

The second on/off-switching device 42-1 is disposed between the emission side of the compressor 11 and the second connection pipe 35-1. The second on/off-switching device 42-1 is, for example, an on/off valve and connects or disconnects a flow channel between a bypass pipe 37 on the emission side of the compressor 11 and the second connection pipe 35-1.

The second on/off-switching device 42-2 is disposed between the emission side of the compressor 11 and the second connection pipe 35-2. The second on/off-switching device 42-2 is, for example, an on/off valve and connects or disconnects a flow channel between a bypass pipe 37 on the emission side of the compressor 11 and the second connection pipe 35-2.

The refrigerant circuit of the air-conditioning device 100 includes a bypass pipe 37 that supplies part of a high-temperature high-pressure refrigerant emitted from the compressor 11 to the two parallel heat exchangers 14.

The bypass pipe 37 branches part of the refrigerant emitted from the compressor 11 to flow into the parallel heat exchanger 14 selected as a defrosting target by the flow channel-switching unit 40. For example, one end of the bypass pipe 37 is connected to the emission pipe 31 and the other end thereof is branched and is connected to the second connection pipes 35 (35-1, 35-2).

The flow rate-adjusting device 18 is disposed between the emission pipe 31 and the bypass pipe 37 and adjusts a flow rate of the refrigerant flowing in the bypass pipe 37.

The outdoor fan 19 is an air blower that blows air to the plurality of parallel heat exchangers 14. The outdoor fan 19 sends outside air to the parallel heat exchangers 14.

The plurality of temperature-detecting units 51 (51-1, 51-2) are, for example, temperature sensors and detect the temperature of the refrigerant in the plurality of parallel heat exchangers 14. Each temperature-detecting unit 51 detects the temperature of a refrigerant evaporating or being used for defrosting in the corresponding parallel heat exchanger 14.

In this embodiment, the temperature-detecting unit 51-1 and the temperature-detecting unit 51-2 have the same configuration and are referred to as the temperature-detecting units 51 when they indicate arbitrary temperature-detecting units of the air-conditioning device 100 or when they are not particularly distinguished.

The temperature-detecting unit 51-1 is disposed in the parallel heat exchanger 14-1 and detects a temperature of a refrigerant in the parallel heat exchanger 14-1. The temperature-detecting unit 51-2 is disposed in the parallel heat exchanger 14-2 and detects a temperature of a refrigerant in the parallel heat exchanger 14-2.

The temperature-detecting units 51 (51-1, 51-2) may be disposed in the first connection pipes 34 (34-1, 34-1) or the second connection pipes 35 (35-1, 35-2). Each temperature-detecting unit 51 may detect a pressure of a refrigerant using a pressure detector instead of a temperature sensor and indirectly detect the temperature of the refrigerant using a saturation temperature thereof.

The control device 60 includes, for example, a central processing unit (CPU) and controls operations of various control units and switching of an operation mode. The control device 60 includes, for example, control boards installed in the outdoor unit 10 and the indoor unit 20 and a remote controller provided indoors.

The control device 60 includes an operation control unit 61, an erroneous installation-sensing unit 62, and a notification output unit 63.

The operation control unit 61 controls operations of various control units and switching of the operation mode. The operation control unit 61 operates the cooling/heating-switching unit 12 such that the operation mode switches between a cooling operation mode and a heating operation mode. Here, the cooling operation mode is an operation mode in which the air-conditioning device 100 performs a cooling operation. The heating operation mode is an operation mode in which the air-conditioning device 100 performs a heating operation. The heating operation mode includes a normal heating operation mode and a defrosting heating operation mode. In the following description, the defrosting heating operation mode may be referred to as a continuous heating operation mode.

The operation control unit 61 controls the cooling/heating-switching unit 12 such that switching A is set when the operation mode is switched to the cooling operation mode. The operation control unit 61 controls the cooling/heating-switching unit 12 such that switching B is set when the operation mode is switched to the heating operation mode.

The operation control unit 61 operates the flow channel-switching unit 40 to switch between the normal heating operation mode and the defrosting heating operation mode. Here, the normal heating operation mode is an operation mode in which both the parallel heat exchangers 14 serve as evaporators and is a normal heating operation mode. That is, in the normal heating operation mode, both the parallel heat exchanger 14-1 and the parallel heat exchanger 14-2 operate as normal evaporators.

The defrosting heating operation mode is an operation mode in which one parallel heat exchanger 14 of the plurality of parallel heat exchangers 14 is selected as defrosting target, part of the refrigerant is caused to flow therein via the bypass pipe 37, and the other parallel heat exchanger 14 serves as an evaporator. In the defrosting heating operation mode, defrosting is performed on one of the parallel heat exchanger 14-1 and the parallel heat exchanger 14-2 while continuing to perform the heating operation.

For example, when the operation mode is switched to the normal heating operation mode, the operation control unit 61 sets the first on/off-switching device 41-1 and the first on/off-switching device 41-2 to an ON state and sets the second on/off-switching device 42-1 and the second on/off-switching device 42-2 to an OFF state. In this case, the parallel heat exchanger 14-1 and the parallel heat exchanger 14-2 serve as evaporators.

When the parallel heat exchanger 14-1 is selected as a defrosting target in the defrosting heating operation mode, the operation control unit 61 sets the first on/off-switching device 41-1 to the OFF state, sets the second on/off-switching device 42-1 to the ON state, sets the first on/off-switching device 41-2 to the ON state, and sets the second on/off-switching device 42-2 to the OFF state. In this case, the parallel heat exchanger 14-1 is subjected to defrosting and the parallel heat exchanger 14-2 serves as an evaporator.

When the parallel heat exchanger 14-2 is selected as a defrosting target in the defrosting heating operation mode, the operation control unit 61 sets the first on/off-switching device 41-2 to the OFF state, sets the second on/off-switching device 42-2 to the ON state, sets the first on/off-switching device 41-1 to the ON state, and sets the second on/off-switching device 42-1 to the OFF state. In this case, the parallel heat exchanger 14-2 is subjected to defrosting and the parallel heat exchanger 14-1 serves as an evaporator.

The operation control unit 61 determines whether defrosting is completed, for example, based on the detected temperature of the refrigerant in the parallel heat exchanger 14 serving as a defrosting target detected by the temperature-detecting unit 51 (51-1, 51-2). The operation control unit 61 determines that defrosting of the parallel heat exchanger 14 serving as a defrosting target is completed, for example, when the detected temperature of the refrigerant in the parallel heat exchanger 14 serving as a defrosting target is higher than the melting temperature of frost (0° C.).

The erroneous installation-sensing unit 62 senses erroneous installation of an installed component associated with defrosting based on the detected temperatures in the plurality of parallel heat exchangers 14 detected by the temperature-detecting unit 51. That is, the erroneous installation-sensing unit 62 performs an erroneous installation-sensing process of sensing erroneous installation of an installed component associated with defrosting in a state in which the operation mode is switched to the defrosting heating operation mode. Examples of the installed component associated with defrosting include the flow channel-switching unit 40 and the temperature-detecting units 51.

The erroneous installation-sensing unit 62 senses that the flow channel-switching unit 40 or the temperature-detecting unit 51 is erroneously installed when the detected temperature in the parallel heat exchanger 14 serving as a defrosting target is equal to or lower than the detected temperature in the parallel heat exchanger 14 serving as an evaporator.

When erroneous installation of an installed component is sensed, the erroneous installation-sensing unit 62 causes the notification output unit 63 to output notification information based on the sensing result of erroneous installation of an installed component. That is, the erroneous installation-sensing unit 62 notifies the outside of the air-conditioning device 100 that erroneous installation is sensed using the notification output unit 63.

The notification output unit 63 is, for example, a display unit of a remote controller or a speaker for outputting alarm sound. The notification output unit 63 outputs the sensing result from the erroneous installation-sensing unit 62. For example, when the notification output unit 63 is a display unit of a remote controller, the notification output unit 63 displays notification information based on the sensing result of erroneous installation of an installed component. The sensing result of erroneous installation includes a sensing result indicating normal installation.

States of the cooling/heating-switching unit 12 and the flow channel-switching unit 40 corresponding to the operation modes of the air-conditioning device 100 are described below with reference to FIG. 3.

FIG. 3 is a drawing illustrating states of the cooling/heating-switching unit 12 and the flow channel-switching unit 40 corresponding to the operation modes of the air-conditioning device 100 according to this embodiment.

In FIG. 3, an "ON" state of each of the first on/off-switching device 41-1, the first on/off-switching device 41-2, the second on/off-switching device 42-1, and the second on/off-switching device 42-2 of the flow channel-switching unit 40 represents a state in which both ends thereof are connected, and an "OFF" state thereof represents a state in which both ends thereof are disconnected. A path using the second connection pipe 35-1 is referred to as "path 1," and a case in which the parallel heat exchanger 14-1 is selected as a defrosting target and defrosting is performed via the path using the second connection pipe 35-1 is referred to as "path 1-side defrosting." A path using the second connection pipe 35-1 is referred to as "path 2," and a case in which the parallel heat exchanger 14-2 is selected as a defrosting target and defrosting is performed via the path using the second connection pipe 35-2 is referred to as "path 2-side defrosting."

For example, when the operation mode is the cooling operation mode, the operation control unit 61 sets the cooling/heating-switching unit 12 to "switching A," sets the first on/off-switching device 41-1 and the first on/off-switching device 41-2 to the "ON" state, and sets the second on/off-switching device 42-1 and the second on/off-switching device 42-2 to the "OFF" state.

For example, when the operation mode is the normal heating operation mode, the operation control unit 61 sets the cooling/heating-switching unit 12 to "switching B," sets the first on/off-switching device 41-1 and the first on/off-switching device 41-2 to the "ON" state, and sets the second on/off-switching device 42-1 and the second on/off-switching device 42-2 to the "OFF" state.

For example, when the operation mode is the defrosting heating operation mode and Path 1 is selected as a defrosting target (when "Path 1-side defrosting" is performed), the operation control unit 61 sets the cooling/heating-switching unit 12 to "switching B," sets the first on/off-switching device 41-1 to the "OFF" state, and sets the first on/off-switching device 41-2 to the "ON" state. In this case, the operation control unit 61 sets the second on/off-switching device 42-1 to the "ON" state and sets the second on/off-switching device 42-2 to the "OFF" state.

For example, when the operation mode is the defrosting heating operation mode and Path 2 is selected as a defrosting target (when "Path 2-side defrosting" is performed), the operation control unit 61 sets the cooling/heating-switching unit 12 to "switching B," sets the first on/off-switching device 41-1 to the "ON" state, and sets the first on/off-switching device 41-2 to the "OFF" state. In this case, the operation control unit 61 sets the second on/off-switching device 42-1 to the "OFF" state and sets the second on/off-switching device 42-2 to the "ON" state.

Operations of the air-conditioning device 100 according to this embodiment are described below with reference to the drawings. The operation in the cooling operation mode of the air-conditioning device 100 are first described.

<Cooling Operation Mode>

Figure 4:
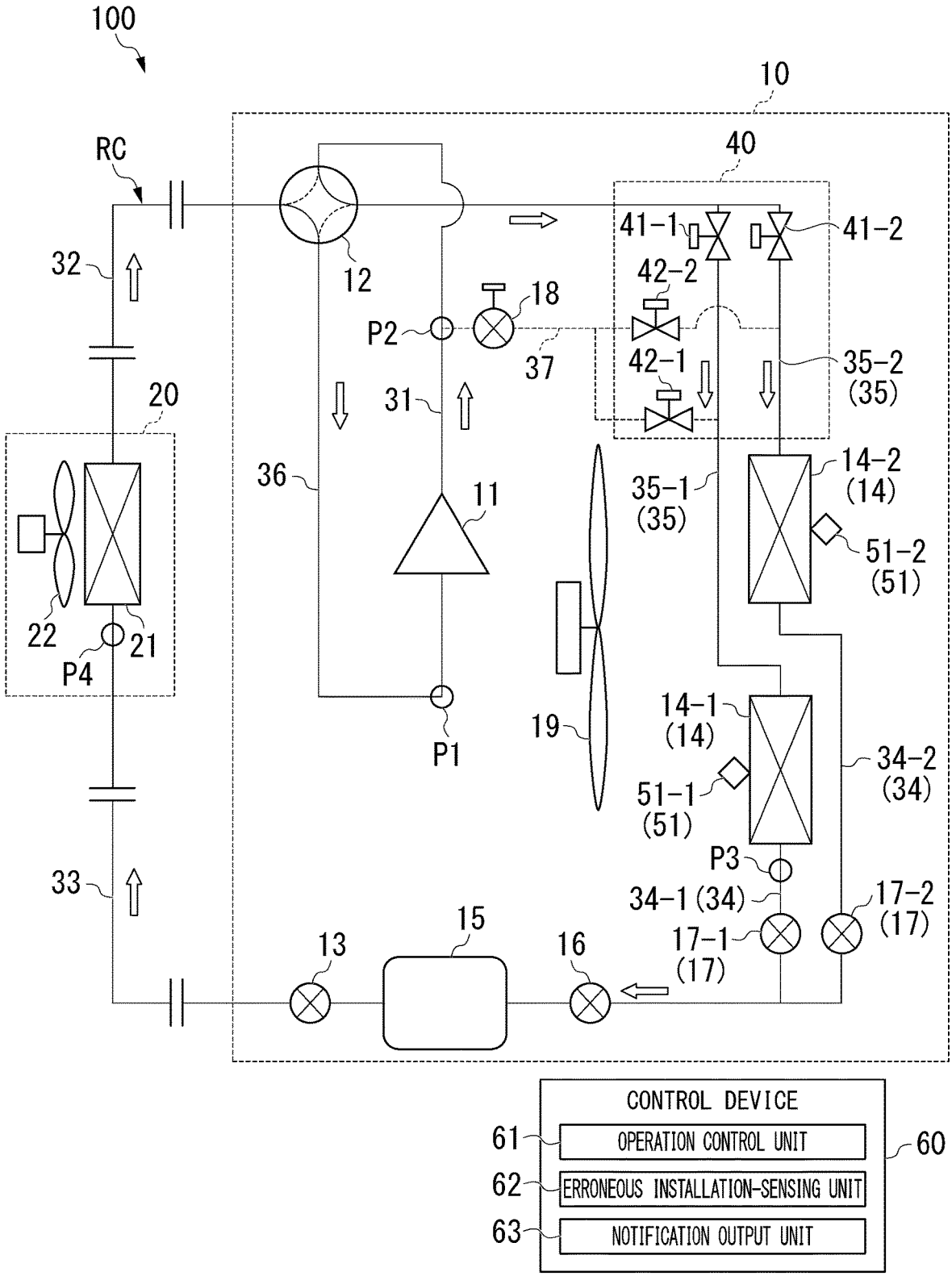
FIG. 4 is a drawing illustrating the flow of a refrigerant in a cooling operation mode of the air-conditioning device according to the first embodiment.

FIG. 4 is a drawing illustrating the flow of a refrigerant in the cooling operation mode of the air-conditioning device 100 according to this embodiment. In FIG. 4, parts in which a refrigerant flows in the cooling operation mode are indicated by a solid line, and parts in which a refrigerant does not flow are indicated by a dashed line.

Figure 5:
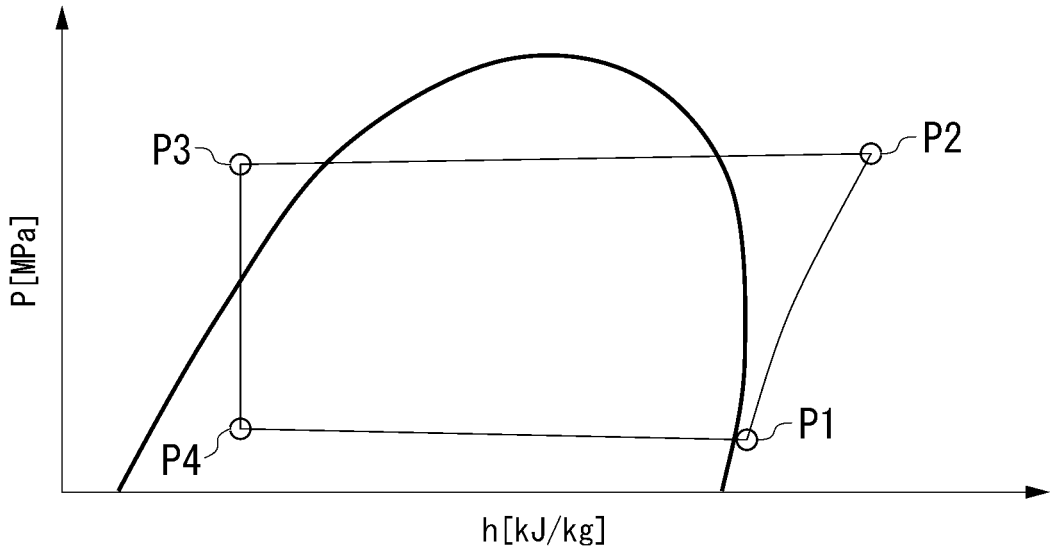
FIG. 5 is a P-h drawing in the cooling operation mode of the air-conditioning device according to the first embodiment.

FIG. 5 is a P-h drawing in the cooling operation mode of the air-conditioning device 100 according to this embodiment. In FIG. 5, the vertical axis represents a pressure P [MPa (megapascal)] of a refrigerant, and the horizontal axis represents specific enthalpy h [kJ (kilojoule)/kg (kilogram)]. Points P1 to P4 in FIG. 5 represent refrigerant states in the parts referred to by the same reference signs in FIG. 4.

In FIG. 5, when the compressor 11 starts its operation, the compressor 11 compresses a low-temperature low-pressure gas refrigerant and emits a high-temperature high-pressure gas refrigerant. The refrigerant compression process in the compressor 11 is performed such that the gas refrigerant is more heated by the adiabatic efficiency of the compressor 11 in comparison with a case in which the refrigerant is adiabatically compressed along an isoentropic line and is indicated by a line extending from the point P1 to the point P2 in FIG. 5.

The high-temperature high-pressure gas refrigerant emitted from the compressor 11 branches into two refrigerants while passing through the cooling/heating-switching unit 12 and passes through the first on/off-switching device 41-1 and the first on/off-switching device 41-2. The gas refrigerants passing through the first on/off-switching device 41-1 and the first on/off-switching device 41-2 flow into the parallel heat exchanger 14-1 and the parallel heat exchanger 14-2 connected thereto via the second connection pipe 35-1 and the second connection pipe 35-2.

The parallel heat exchanger 14-1 and the parallel heat exchanger 14-2 cool the refrigerant flowing thereinto while heating the outside air. As a result, the refrigerants change to intermediate-temperature high-pressure liquid refrigerants.

The refrigerant change in the parallel heat exchanger 14-1 and the parallel heat exchanger 14-2 is indicated by a slightly oblique straight line extending approximately horizontally and extending from the point P2 to the point P3 in FIG. 5 in consideration of a pressure loss.

The intermediate-temperature high-pressure liquid refrigerants flowing out from the parallel heat exchanger 14-1 and the parallel heat exchanger 14-2 flow into the first connection pipe 34-1 and the first connection pipe 34-2, pass through the second decompressor 17-1 and the second decompressor 17-2, and then merge. The merged refrigerant is expanded and decompressed and falls into a low-temperature low-pressure state with two phases of gas and liquid while passing through the third decompressor 16, the receiver 15, and the first decompressor 13. Change of the refrigerant in the second decompressor 17-1, the second decompressor 17-2, the third decompressor 16, the receiver 15, and the first decompressor 13 is carried out with constant enthalpy. The refrigerant change at this time is indicated by a vertical line extending from the point P3 to the point P4 in FIG. 5.

The refrigerant in the low-temperature low-pressure state with two phases of gas and liquid flowing out from the first decompressor 13 flows out from the outdoor unit 10, passes through the second extension pipe 33, and flows into the indoor heat exchanger 21 of the indoor unit 20. The indoor heat exchanger 21 heats the flowed refrigerant while cooling the inside air. As a result, the refrigerant changes to a low-temperature low-pressure gas refrigerant. The refrigerant change in the indoor heat exchanger 21 is indicated by a slightly oblique straight line extending approximately horizontally and extending from the point P4 to the point P1 in FIG. 5 in consideration of a pressure loss.

The low-temperature low-pressure gas refrigerant flowing out from the indoor heat exchanger 21 returns to the outdoor unit 10 via the first extension pipe 32, flows into the compressor 11 via the cooling/heating-switching unit 12, and is compressed therein.

<Normal Heating Operation Mode>

Figure 6:
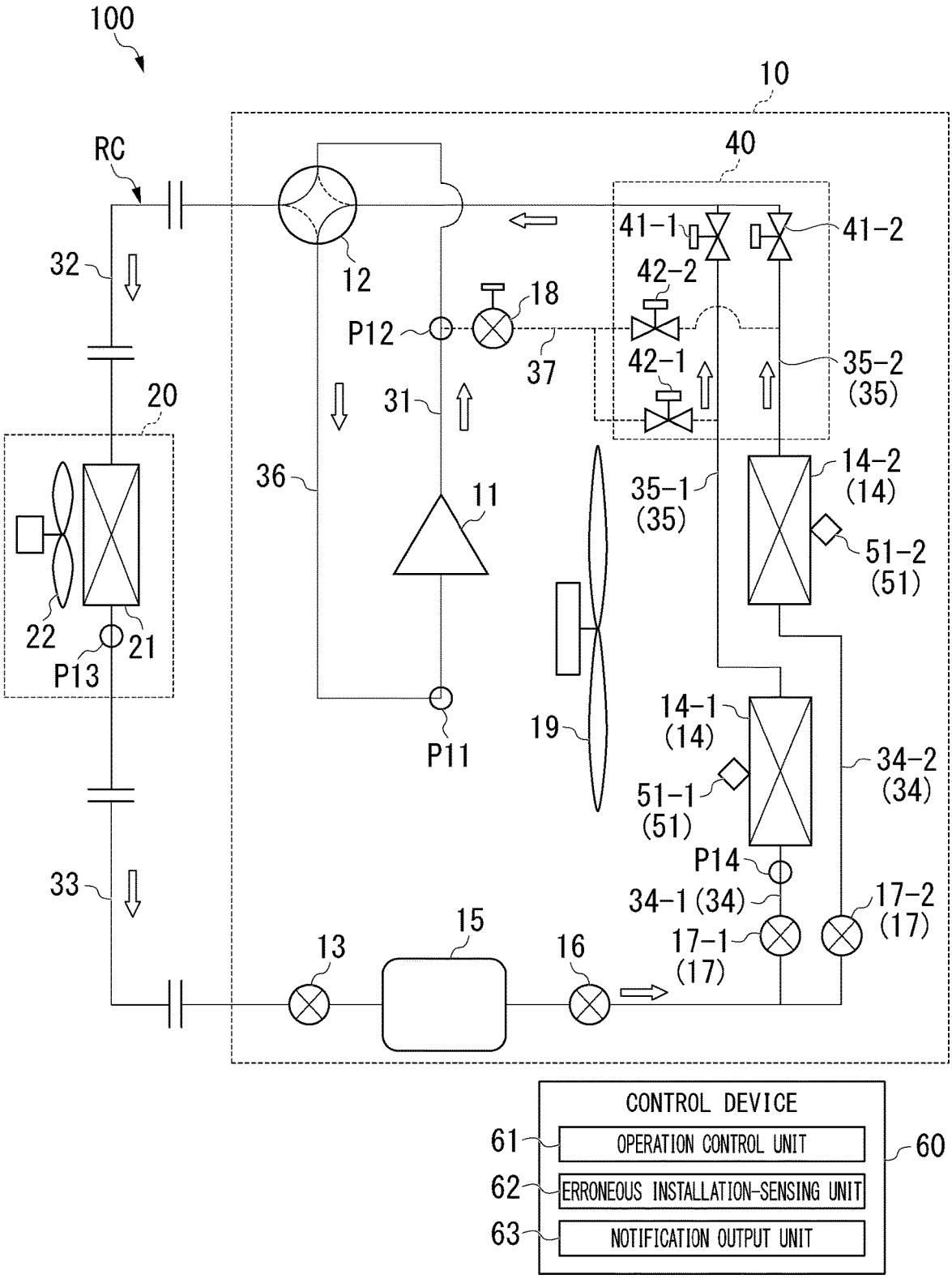
FIG. 6 is a drawing illustrating the flow of a refrigerant in a normal heating operation mode of the air-conditioning device according to the first embodiment.

FIG. 6 is a drawing illustrating the flow of a refrigerant in the normal heating operation mode of the air-conditioning device 100 according to this embodiment. In FIG. 6, parts in which a refrigerant flows in the normal heating operation mode are indicated by a solid line, and parts in which a refrigerant does not flow are indicated by a dashed line.

Figure 7:
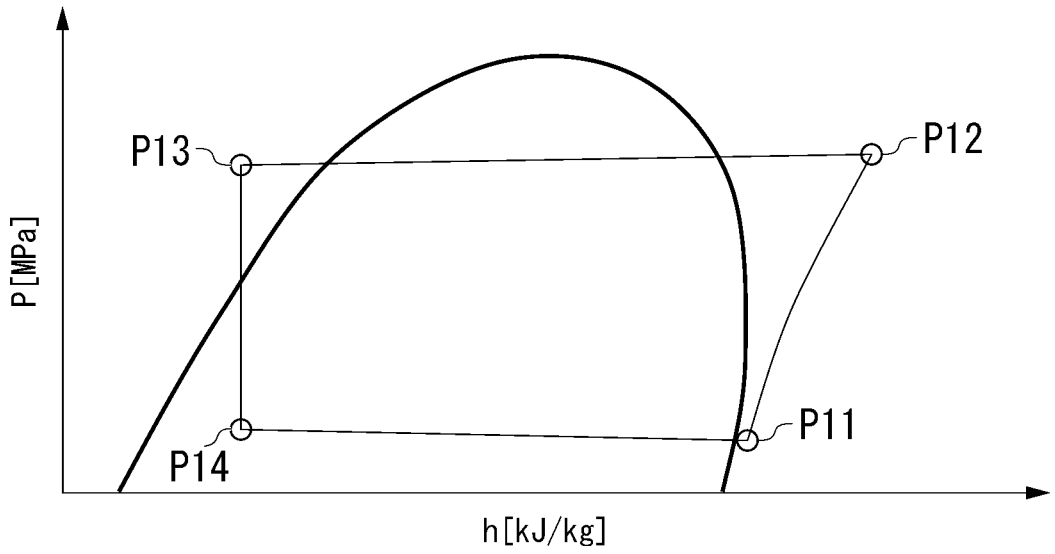
FIG. 7 is a P-h drawing in the normal heating operation mode of the air-conditioning device according to the first embodiment.

FIG. 7 is a P-h drawing in the normal heating operation mode of the air-conditioning device 100 according to this embodiment. In FIG. 7, the vertical axis represents a pressure P [MPa] of a refrigerant, and the horizontal axis represents specific enthalpy h [kJ/kg]. Points P11 to P14 in FIG. 7 represent refrigerant states in the parts referred to by the same reference signs in FIG. 6.

In FIG. 6, when the compressor 11 starts its operation, the compressor 11 compresses a low-temperature low-pressure gas refrigerant and emits a high-temperature high-pressure gas refrigerant. The refrigerant compression process in the compressor 11 is indicated by a line extending from the point P11 to the point P12 in FIG. 7.

The high-temperature high-pressure gas refrigerant emitted from the compressor 11 passes through the cooling/heating-switching unit 12 and flows out from the outdoor unit 10. The high-temperature high-pressure gas refrigerant flowing out from the outdoor unit 10 flows into the indoor heat exchanger 21 of the indoor unit 20 via the first extension pipe 32.

The indoor heat exchanger 21 cools the refrigerant flowing thereinto while heating the inside air. As a result, the refrigerant change to an intermediate-temperature high-pressure liquid refrigerant. The refrigerant change in the indoor heat exchanger 21 is indicated by a slightly oblique straight line extending approximately horizontally and extending from the point P12 to the point P13 in FIG. 7 in consideration of a pressure loss.

The intermediate-temperature high-pressure liquid refrigerant flowing out from the indoor heat exchanger 21 returns to the outdoor unit 10 via the second extension pipe 33. The refrigerant returning to the outdoor unit 10 passes through the first decompressor 13, the receiver 15, and the third decompressor 16 and branches, and the branched refrigerants flow into the second decompressor 17-1 and the second decompressor 17-2 via the first connection pipe 34-1 and the first connection pipe 34-2. The refrigerants are expanded and decompressed and falls into a low-temperature low-pressure state with two phases of gas and liquid while passing through the first decompressor 13, the third decompressor 16, and the second decompressor 17. Change of the refrigerant in the first decompressor 13, the third decompressor 16, and the second decompressor 17 is carried out with constant enthalpy. The refrigerant change at this time is indicated by a vertical line extending from the point P13 to the point P14 in FIG. 7.

The refrigerants flowing out from the second decompressor 17-1 and the second decompressor 17-2 flows into the parallel heat exchanger 14-1 and the parallel heat exchanger 14-2. The parallel heat exchanger 14-1 and the parallel heat exchanger 14-2 heats the refrigerants while cooling the outside air. As a result, the refrigerants change to low-temperature low-pressure gas refrigerants. The refrigerant change in the parallel heat exchanger 14-1 and the parallel heat exchanger 14-2 is indicated by a slightly oblique straight line extending approximately horizontally and extending from the point P14 to the point P11 in FIG. 7 in consideration of a pressure loss.

The low-temperature low-pressure gas refrigerants flowing out from the parallel heat exchanger 14-1 and the parallel heat exchanger 14-2 flow into the second connection pipe 35-1 and the second connection pipe 35-2, pass through the first on/off-switching device 41-1 and the first on/off-switching device 41-2 and then merge, and the merged refrigerant flows into the compressor 11 via the cooling/heating-switching unit 12 and is compressed therein.

<Defrosting Heating Operation (Continuous Heating Operation) Mode>

The defrosting heating operation mode is carried out when the parallel heat exchanger 14 is frosted in the normal heating operation mode. The operation control unit 61 of the control device 60 determines whether the parallel heat exchanger 14 is frosted and determines whether a defrosting heating operation needs to be carried out based on the result of determination. The operation control unit 61 determines whether the parallel heat exchanger 14 is frosted, for example, based on a refrigerant saturation temperature to which a suction pressure of the compressor 11 is converted.

For example, when a refrigerant saturation temperature is much lower than a set outside air temperature and is less than a threshold value, the operation control unit 61 determines that the parallel heat exchanger 14 has frost requiring defrosting. For example, when a temperature difference between the outside air temperature and an evaporation temperature is equal to or greater than a preset value and an elapsed time in that state is equal to or greater than a predetermined period, the operation control unit 61 determines that the parallel heat exchanger 14 has frost requiring defrosting. The determination of whether there is frost is not limited to this determination method, and may be performed using another method.

When it is determined that the parallel heat exchanger 14 is frosted, the operation control unit 61 determines that a starting condition for starting the defrosting heating operation is satisfied. When it is determined that the start condition is satisfied, the operation control unit 61 switches the operation mode to the defrosting heating operation mode.

With the configuration of the air-conditioning device 100 according to this embodiment, it is possible to perform a continuous heating operation in which the parallel heat exchanger 14-2 is selected as a defrosting target and is subjected to defrosting (Path 2-side defrosting) and the parallel heat exchanger 14-1 serves as an evaporator in the defrosting heating operation mode. Also, on the other hand, it is possible to perform an operation in which the parallel heat exchanger 14-1 is selected as a defrosting target and is subjected to defrosting (path 1-side defrosting) and the parallel heat exchanger 14-2 serves as an evaporator.

The operation in which path 1-side defrosting is performed and the operation in which path 2-side defrosting is performed are the same except that the on/off states of the first on/off-switching device 41-1, the first on/off-switching device 41-2, the second on/off-switching device 42-1, and the second on/off-switching device 42-2 are different, and the parallel heat exchanger 14 serving as a defrosting target and the parallel heat exchanger 14 serving as an evaporator are exchanged to change the flow of the refrigerant in the parallel heat exchangers 14. Accordingly, in the following description, it is assumed that the continuous heating operation in which defrosting of the parallel heat exchanger 14-2 (path 2-side defrosting) is performed and the parallel heat exchanger 14-1 serves as an evaporator is performed. The same is assumed in the following description of embodiments.

Figure 8:
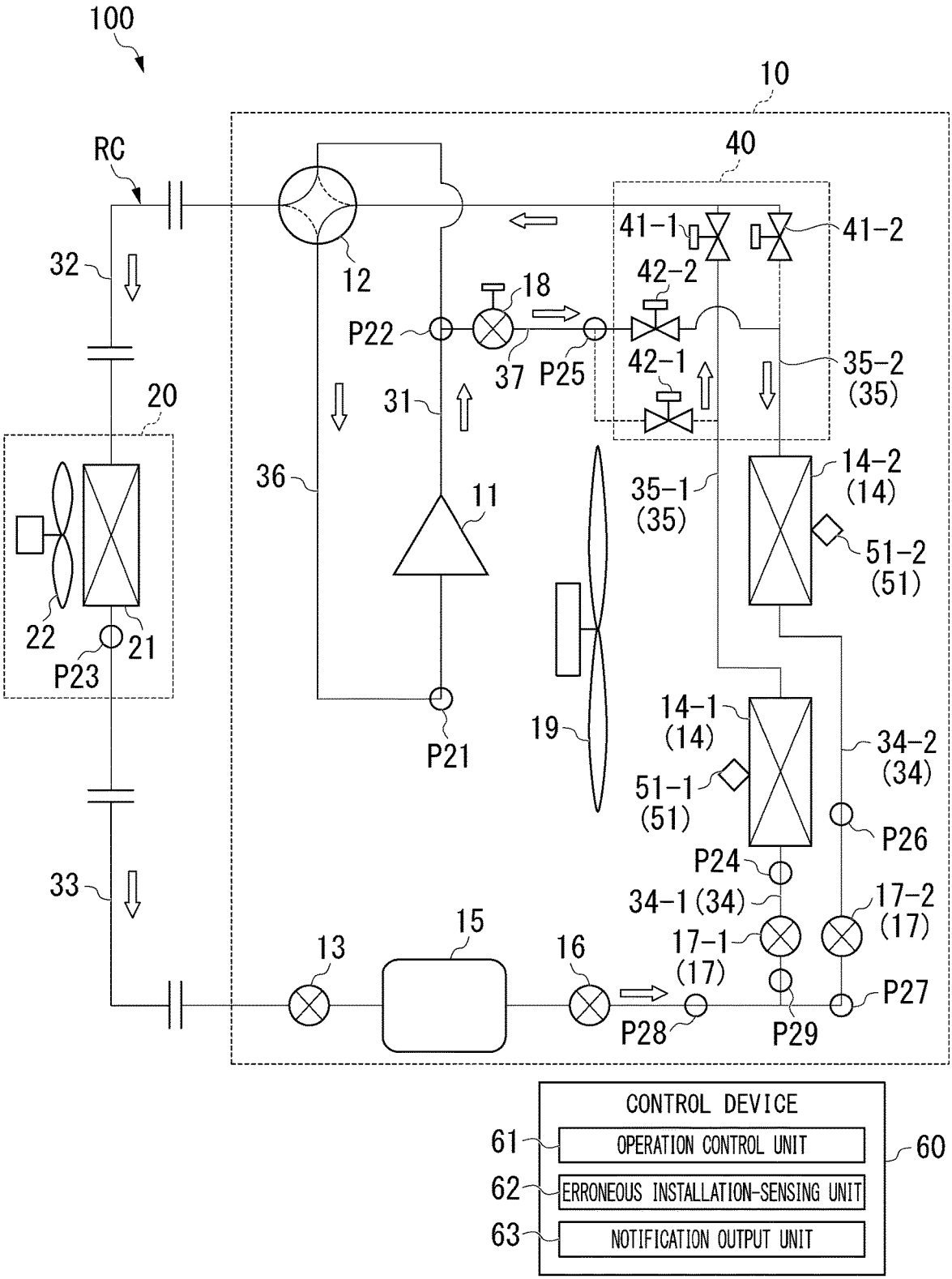
FIG. 8 is a drawing illustrating the flow of a refrigerant in an example of a defrosting heating operation mode of the air-conditioning device according to the first embodiment.

FIG. 8 is a drawing illustrating the flow of a refrigerant in the defrosting heating operation mode of the air-conditioning device 100 according to this embodiment. In the example illustrated in FIG. 8, path 2-side defrosting is performed, parts in which a refrigerant flows in the defrosting heating operation mode are indicated by a solid line, and parts in which a refrigerant does not flow are indicated by a dashed line.

Figure 9:
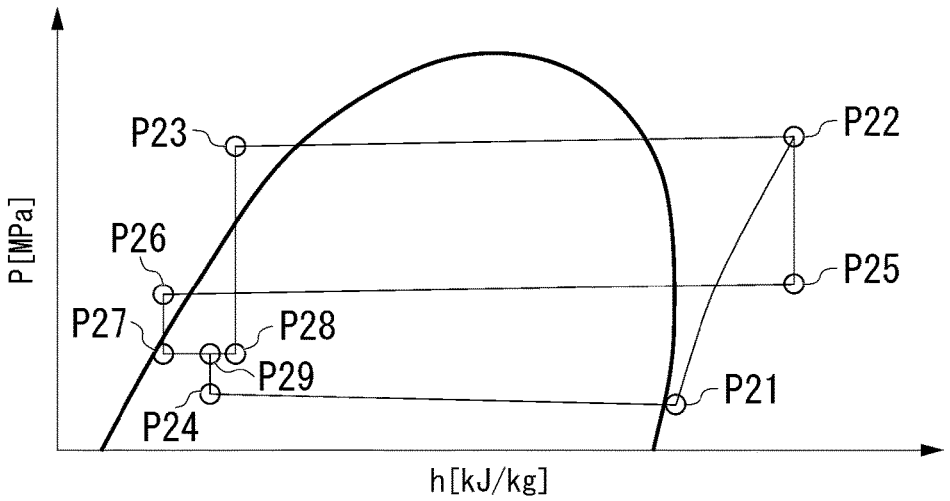
FIG. 9 is a P-h drawing illustrating the flow of a refrigerant in an example of a defrosting heating operation mode of the air-conditioning device according to the first embodiment.

FIG. 9 is a P-h drawing in the defrosting heating operation mode of the air-conditioning device 100 according to this embodiment. In FIG. 9, the vertical axis represents a pressure P [MPa] of a refrigerant, and the horizontal axis represents specific enthalpy h [kJ/kg]. Points P21 to P29 in FIG. 9 represent refrigerant states in the parts referred to by the same reference signs in FIG. 8.

The operation control unit 61 turns off the first on/off-switching device 41-2 corresponding to the parallel heat exchanger 14-2 serving as a defrosting target in the defrosting heating operation mode in which defrosting of the parallel heat exchanger 14-2 is performed. The operation control unit 61 turns on the second on/off-switching device 42-2 and turns on the flow rate-adjusting device 18. The operation control unit 61 turns on the first on/off-switching device 41-1 corresponding to the parallel heat exchanger 14-1 serving as an evaporator and turns off the second on/off-switching device 42-1.

Accordingly, a defrosting circuit with sequential connection of the compressor 11, the flow rate-adjusting device 18, the second on/off-switching device 42-2, the parallel heat exchanger 14-2 and the second decompressor 17-2 is turned on and the defrosting heating operation is performed.

In FIG. 8, when the defrosting heating operation is performed, part of a high-temperature high-pressure gas refrigerant emitted from the compressor 11 flows into the bypass pipe 37 and is decompressed to an intermediate pressure by the flow rate-adjusting device 18. The refrigerant change at this time is indicated by a line extending from the point P22 to the point P25 in FIG. 9.

Then, the refrigerant decompressed to the intermediate pressure at the point P25 flows into the parallel heat exchanger 14-2 via the second on/off-switching device 42-2. The refrigerant flowing into the parallel heat exchanger 14-2 is cooled by exchange of heat with frost attached to the parallel heat exchanger 14-2.

In this way, by decompressing the high-temperature high-pressure gas refrigerant emitted from the compressor 11 and then causing the refrigerant to flow into the parallel heat exchanger 14-2, frost attached to the parallel heat exchanger 14-2 can be melted. The refrigerant change at this time is indicated by a line extending from the point P25 to the point P26 in FIG. 9.

After defrosting is performed, the refrigerant flowing out from the parallel heat exchanger 14-2 is decompressed while passing through the second decompressor 17-2. The refrigerant change at this time is indicated by a line extending from the point P26 to the point P27 in FIG. 9.

The refrigerant passing through the second decompressor 17-2 merges into that in the main circuit RC. The merged refrigerant passes through the second decompressor 17-1, flows into the parallel heat exchanger 14-1 serving as an evaporator, and is evaporated.

When defrosting of the parallel heat exchanger 14-2 is completed, the operation control unit 61 controls the on/off states of the first on/off-switching device 41-1, the first on/off-switching device 41-2, the second on/off-switching device 42-1, and the second on/off-switching device 42-2 such that defrosting of the parallel heat exchanger 14-1 is performed or the operation mode is switched to the normal heating operation mode.

The operation control unit 61 determines completion of defrosting based on the temperature detected by the temperature-detecting unit 51-2. The operation control unit 61 determines the completion of defrosting, for example, when the detected temperature is higher than a predetermined value higher than a frost melting temperature (0° C.).

<Erroneous Installation-Sensing Process>

The erroneous installation-sensing process of the air-conditioning device 100 according to this embodiment are described below.

Here, an influence when the temperature-detecting unit 51 (51-1, 51-2) or the flow channel-switching unit 40 (the first on/off-switching device 41-1, the first on/off-switching device 41-2, the second on/off-switching device 42-1, and the second on/off-switching device 42-1) is erroneously installed (erroneous installation is performed) are first described below.

For example, when the temperature-detecting unit 51-1 and the temperature-detecting unit 51-2 are inversely installed, the refrigerant temperature of the parallel heat exchanger 14-2 serving as a defrosting target is detected by the temperature-detecting unit 51-1, and the refrigerant temperature of the parallel heat exchanger 14-1 serving as an evaporator is detected by the temperature-detecting unit 51-1. In this case, the refrigerant temperature of the parallel heat exchanger 14-1 serving as an evaporator is lower than 0° C., which is a frosting temperature, and the temperature-detecting unit 51-2 detects the temperature lower than 0° C. Accordingly, since the temperature detected by the temperature-detecting unit 51-2 for determining completion of defrosting is not higher than 0° C., which is a frost melting temperature, the operation control unit 61 cannot correctly determine completion of defrosting.

Also, for example, when the second on/off-switching device 42-1 and the second on/off-switching device 42-2 are inversely installed, the second on/off-switching device 42-2 is connected to the second connection pipe 35-1. Accordingly, since the high-temperature refrigerant passing through the second on/off-switching device 42-2 does not flow into the parallel heat exchanger 14-1 and flows into the compressor 11 via the first on/off-switching device 41-1, the operation control unit 61 cannot perform defrosting of either of the parallel heat exchanger 14-1 and the parallel heat exchanger 14-2.

Therefore, the air-conditioning device 100 according to this embodiment performs the erroneous installation-sensing process of sensing erroneous installation of the temperature-detecting unit 51 (51-1, 51-2) or the flow channel-switching unit 40 (the first on/off-switching device 41-1, the first on/off-switching device 41-2, the second on/off-switching device 42-1, and the second on/off-switching device 42-1).

The erroneous installation-sensing process in the air-conditioning device 100 according to this embodiment are described below with reference to FIG. 10.

Figure 10:
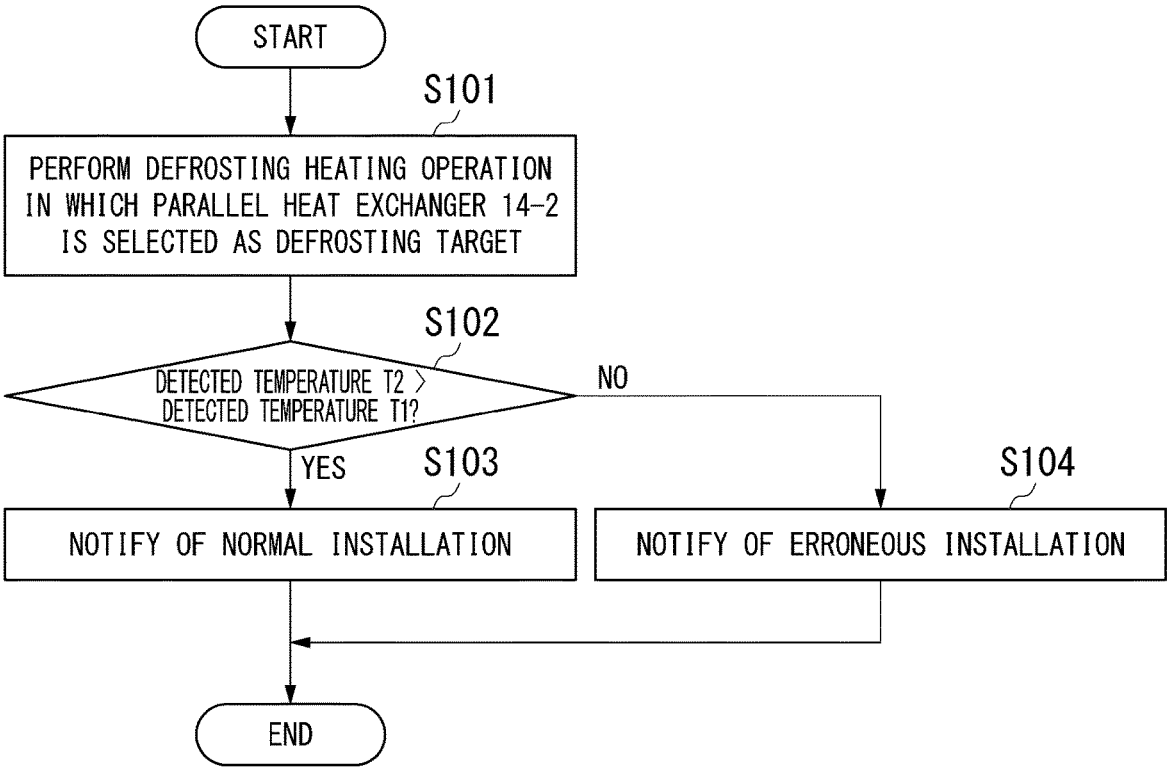
FIG. 10 is a flowchart illustrating an example of an erroneous installation-sensing process of the air-conditioning device according to the first embodiment.

FIG. 10 is a flowchart illustrating an example of the erroneous installation-sensing process in the air-conditioning device 100 according to this embodiment.

The air-conditioning device 100 performs the erroneous installation-sensing process illustrated in FIG. 10 when a starting condition of the erroneous installation-sensing process is satisfied. Examples of the starting condition of the erroneous installation-sensing process include a condition in which the defrosting heating operation is first performed after being powered on, a condition in which the starting is instructed by operating a remote controller or a mobile terminal, and a condition in which the starting is instructed by a switch such as a button switch or a DIP switch provided on a control board of the outdoor unit 10. When the process is started by operating the remote controller or the mobile terminal or the starting is instructed from a switch on the control board, there is an advantage in that the process can be performed at an arbitrary timing by an operator at the time of constructing or maintenance of the outdoor unit 10.

As illustrated in FIG. 10, the operation control unit 61 of the control device 60 first performs the defrosting heating operation in which the parallel heat exchanger 14-2 is selected as a defrosting target (Step S101). That is, the operation control unit 61 sets the cooling/heating-switching unit 12 to switching B, sets the first on/off-switching device 41-1 and the second on/off-switching device 42-2 to the ON state, and sets the first on/off-switching device 41-2 and the second on/off-switching device 42-1 to the OFF state. The operation control unit 61 turns on the flow rate-adjusting device 18 to start the operation of the compressor 11.

Then, the erroneous installation-sensing unit 62 of the control device 60 determines whether the detected temperature T2 is higher than the detected temperature T1 (Step S102). The erroneous installation-sensing unit 62 acquires the detected temperature T1 in the parallel heat exchanger 14-1 from the temperature-detecting unit 51-1 and acquires the detected temperature T2 in the parallel heat exchanger 14-2 from the temperature-detecting unit 51-2. That is, the erroneous installation-sensing unit 62 acquires the detected temperature T1 detected by the temperature-detecting unit 51-1 and the detected temperature T2 detected by the temperature-detecting unit 51-2. The erroneous installation-sensing unit 62 compares the detected temperature T1 in the parallel heat exchanger 14-1 and the detected temperature T2 in the parallel heat exchanger 14-2 and determines whether the detected temperature T2 is higher than the detected temperature T1. When the detected temperature T2 is higher than the detected temperature T1 (Step S102: YES), the erroneous installation-sensing unit 62 causes the process to proceed to Step S103. When the detected temperature T2 is equal to or lower than the detected temperature T1 (Step S102: NO), the erroneous installation-sensing unit 62 causes the process to proceed to Step S104.

In Step S103, the erroneous installation-sensing unit 62 notifies the outside of normal installation. In this case, the erroneous installation-sensing unit 62 causes the notification output unit 63 to output notification information indicating that installation of the temperature-detecting unit 51 (51-1, 51-2) and the flow channel-switching unit 40 (the first on/off-switching device 41-1, the first on/off-switching device 41-2, the second on/off-switching device 42-1, and the second on/off-switching device 42-1) is normal and notifies the outside of the normal installation. After the process of Step S103 is performed, the erroneous installation-sensing unit 62 ends the erroneous installation-sensing process.

In Step S104, the erroneous installation-sensing unit 62 notifies the outside of erroneous installation. In this case, the erroneous installation-sensing unit 62 causes the notification output unit 63 to output notification information indicating that installation of the temperature-detecting unit 51 (51-1, 51-2) or the flow channel-switching unit 40 (the first on/off-switching device 41-1, the first on/off-switching device 41-2, the second on/off-switching device 42-1, or the second on/off-switching device 42-2) is erroneous and notifies the outside of the erroneous installation. After the process of Step S104 is performed, the erroneous installation-sensing unit 62 ends the erroneous installation-sensing process.

The erroneous installation-sensing unit 62 performs notification of the normal installation or the erroneous installation, for example, using a display unit of a remote controller, a display unit provided on a control board of the outdoor unit 10, and a lamp provided on the control board as the notification output unit 63. The erroneous installation-sensing unit 62 may output a notification indicating the normal installation or the erroneous installation to a mobile terminal or the like via the remote controller or the control board.

As described above, the air-conditioning device 100 according to this embodiment includes the main circuit RC, the flow channel-switching unit 40, the bypass pipe 37, the temperature-detecting unit 51, the operation control unit 61, and the erroneous installation-sensing unit 62. In the main circuit RC, the compressor 11, the indoor heat exchanger 21, the decompressor (for example, the first decompressor 13), and a plurality of parallel heat exchangers 14 connected in parallel to each other are connected by a pipe and a refrigerant circulates. The flow channel-switching unit 40 is connected to the plurality of parallel heat exchangers 14 and selects one parallel heat exchanger 14 (for example, the parallel heat exchanger 14-2) out of the plurality of parallel heat exchangers 14 as a defrosting target which is a target of defrosting by melting frost attached to the parallel heat exchanger 14. The bypass pipe 37 causes part of the refrigerant emitted from the compressor 11 to flow into the parallel heat exchanger 14 (for example, the parallel heat exchanger 14-2) selected as a defrosting target by the flow channel-switching unit 40. The temperature-detecting unit 51 detects the temperatures of the refrigerant in the plurality of parallel heat exchangers 14. The operation control unit 61 operates the flow channel-switching unit 40 such that the operation is switched between the normal heating operation mode and the defrosting heating operation mode. Here, the normal heating operation mode is an operation mode in which the plurality of parallel heat exchangers 14 serve as evaporators. The defrosting heating operation mode is an operation mode in which one parallel heat exchanger 14 (for example, the parallel heat exchanger 14-2) out of the plurality of parallel heat exchangers 14 is selected as a defrosting target, part of the refrigerant flows thereinto via the bypass pipe 37, and the other parallel heat exchanger 14 (for example, the parallel heat exchanger 14-1) out of the plurality of parallel heat exchangers 14 serves as an evaporator. The erroneous installation-sensing unit 62 senses erroneous installation of an installed component associated with defrosting (for example, the temperature-detecting unit 51 or the flow channel-switching unit 40) based on the detected temperatures in the plurality of parallel heat exchangers 14 detected by the temperature-detecting unit 51.

Accordingly, the air-conditioning device 100 according to this embodiment can sense erroneous installation of an installed component (for example, the temperature-detecting unit 51 or the flow channel-switching unit 40) associated with defrosting and perform defrosting normally without stopping heating of the indoor unit 20.

In this embodiment, the erroneous installation-sensing unit 62 senses that the flow channel-switching unit 40 or the temperature-detecting unit 51 is erroneously installed when the detected temperature (for example, the detected temperature T2) in the parallel heat exchanger 14 (for example, the parallel heat exchanger 14-2) serving as a defrosting target is equal to or lower than the detected temperature (for example, equal to or lower than the detected temperature T1) in the parallel heat exchanger 14 (for example, the parallel heat exchanger 14-1) serving as an evaporator in the state in which the operation mode is switched to the defrosting heating operation mode.

Accordingly, the air-conditioning device 100 according to this embodiment can appropriately sense that the flow channel-switching unit 40 or the temperature-detecting unit 51 is erroneously installed by comparing the detected temperature T2 of the refrigerant in the parallel heat exchanger 14-2 serving as a defrosting target with the detected temperature T1 of the refrigerant in the parallel heat exchanger 14-1 serving as an evaporator.

In this embodiment, the erroneous installation-sensing unit 62 causes the notification output unit 63 to output notification information based on the result of sensing of erroneous installation of an installed component when erroneous installation of the installed component is sensed.

Accordingly, with the air-conditioning device 100 according to this embodiment, when erroneous installation of the installed component is sensed, a user can recognize erroneous installation of an installed component or normal installation of an installed component.

In this embodiment, when the starting condition of the process of sensing erroneous installation of an installed component is satisfied, the erroneous installation-sensing unit 62 senses erroneous installation of an installed component in a state in which the operation mode is switched to the defrosting heating operation mode.

Accordingly, the air-conditioning device 100 according to this embodiment can ascertain erroneous installation of an installed component at a timing suitable for the starting condition.

Also, in the above described FIG. 8, the air-conditioning device 100 according to this embodiment can melt frost by causing a high-temperature high-pressure gas refrigerant to flow into the parallel heat exchanger 14-2 without decompressing the gas refrigerant even when the flow rate-adjusting device 18 is not provided. However, when a refrigerant with a high pressure and a high saturation temperature flows into the parallel heat exchanger 14-2, the refrigerant condenses immediately due to a large temperature difference from the frost melting point (0° C.). Accordingly, since an amount of liquid refrigerant in the parallel heat exchanger 14-2 increases and an amount of refrigerant used for heating is insufficient, heating capability decreases.

Therefore, the air-conditioning device 100 according to this embodiment can lower the saturation temperature of the refrigerant and suppress an amount of liquid refrigerant in the parallel heat exchanger 14-2 by decompressing the refrigerant emitted from the compressor 11 and causing the refrigerant to flow into the parallel heat exchanger 14-2 using the flow rate-adjusting device 18. Accordingly, with the air-conditioning device 100 according to this embodiment, it is possible to enhance indoor comfortability.

In the erroneous installation-sensing process illustrated in the above described FIG. 10, the outdoor fan 19 may operate or may not operate. By stopping the outdoor fan 19, the refrigerant temperature in the parallel heat exchanger 14 serving as an evaporator is likely to decrease and the refrigerant temperature in the other heat exchanger is likely to increase. Accordingly, the air-conditioning device 100 according to this embodiment can easily sense a temperature difference between the detected temperature T1 and the detected temperature T2 by stopping the outdoor fan 19.

Also, on the other hand, by causing the outdoor fan 19 to operate, evaporation of the refrigerant is promoted. Accordingly, with the air-conditioning device 100 according to this embodiment, it is possible to prevent intake of a liquid refrigerant into the compressor 11 by causing the outdoor fan 19 to operate.

In the erroneous installation-sensing process according to this embodiment, the first decompressor 13 or the third decompressor 16 may be turned on or may be turned off. For example, by turning off the first decompressor 13 or the third decompressor 16, the refrigerant circuit on the indoor unit 20 side in the air-conditioning device 100 according to this embodiment is closed and a path in which a refrigerant flows decreases. Accordingly, since a difference between the emission pressure and the intake pressure of the compressor 11 increases and, by the increased difference, the temperature difference of the refrigerant between the parallel heat exchanger 14 serving as an evaporator and the other parallel heat exchanger 14 increases, the air-conditioning device 100 according to this embodiment can easily sense the temperature difference between the detected temperature T1 and the detected temperature T2.

For example, by turning on the first decompressor 13 and the third decompressor 16, the air-conditioning device 100 according to this embodiment can store an unnecessary refrigerant in the receiver 15, and thus it is possible to prevent intake of a liquid refrigerant into the compressor 11.

Also, in the above described FIG. 10, an example in which the parallel heat exchanger 14-1 serves as an evaporator, the parallel heat exchanger 14-2 is selected as a defrosting target, and the erroneous installation-sensing process is performed is described, but the parallel heat exchanger 14-1 may be selected as a defrosting target, the parallel heat exchanger 14-2 may serve as an evaporator, and the erroneous installation-sensing process may be performed. In this case, in Step S102 in FIG. 10, the determination condition is inverted, and normal installation is sensed when the detected temperature T1 is higher than the detected temperature T2.

Second Embodiment

An air-conditioning device 100*a* according to a second embodiment of the present disclosure are described below. In this embodiment, a modified example in which a plurality of outdoor fans 19 are provided and airflow volumes blown to a plurality of parallel heat exchangers 14 can be changed are described.

Figure 11:
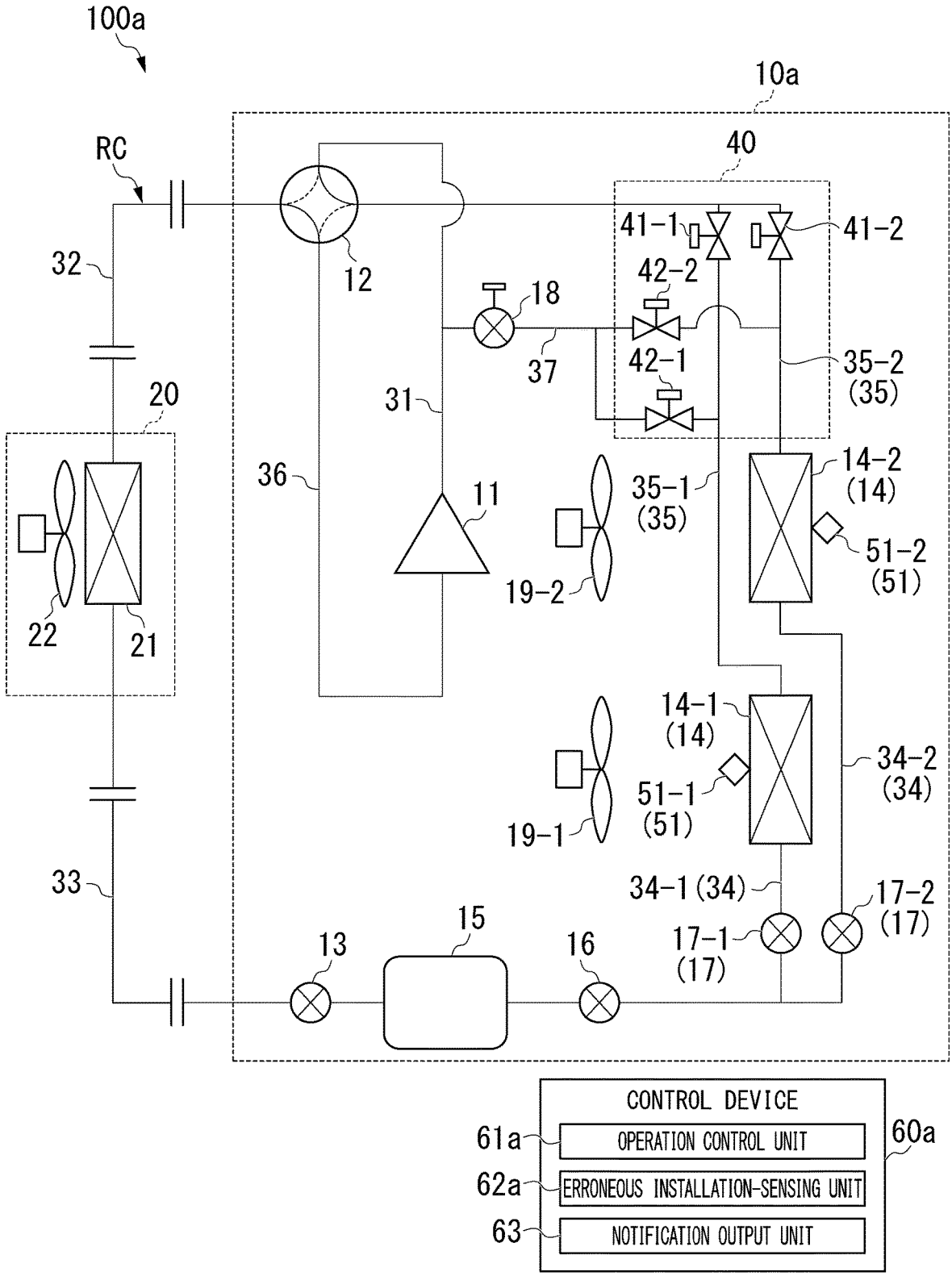
FIG. 11 is a drawing illustrating an example of a configuration of an air-conditioning device according to a second embodiment.

FIG. 11 is a drawing illustrating an example of a configuration of the air-conditioning device 100*a* according to the second embodiment.

As illustrated in FIG. 11, the air-conditioning device 100*a* includes an outdoor unit 10*a*, an indoor unit 20, and a control device 60*a*.

In FIG. 11, the same elements as in FIG. 1 are referred to by the same reference signs and description thereof are omitted. In the following description, differences of the air-conditioning device 100*a* from the configuration in the first embodiment are mainly described.

The outdoor unit 10*a* includes a compressor 11, a cooling/heating-switching unit 12, a first decompressor 13, a plurality of parallel heat exchangers 14 (14-1 and 14-2), a receiver 15, a third decompressor 16, a plurality of second decompressors 17 (17-1 and 17-2), a flow rate-adjusting device 18, a plurality of outdoor fans (19-1 and 19-2), a flow channel-switching unit 40, and a plurality of temperature-detecting units 51 (51-1 and 51-2). The outdoor unit 10*a* is different from the outdoor unit 10 according to the first embodiment in that the plurality of outdoor fans (19-1 and 19-2) corresponding to the plurality of parallel heat exchangers 14 (14-1 and 14-2) are provided.

The outdoor fan 19-1 is an air blower that blows air to the parallel heat exchanger 14-1. The outdoor fan 19-1 sends outside air to the parallel heat exchanger 14-1.

The outdoor fan 19-2 is an air blower that blows air to the parallel heat exchanger 14-2. The outdoor fan 19-2 sends outside air to the parallel heat exchanger 14-2.

The control device 60*a* includes, for example, a CPU and controls operations of various control units and switching of an operation mode. The control device 60*a* includes, for example, control boards installed in the outdoor unit 10*a* and the indoor unit and a remote controller grounded indoors.

The control device 60*a* includes an operation control unit 61*a*, an erroneous installation-sensing unit 62*a*, and a notification output unit 63.

The basic function of the operation control unit 61*a* is the same as the operation control unit 61 according to the first embodiment. The operation control unit 61*a* is different from the operation control unit 61 according to the first embodiment in that control of two outdoor fans (19-1 and 19-2) is performed.

The operation control unit 61*a* controls the two outdoor fans (19-1 and 19-2) such that an airflow volume for the parallel heat exchanger 14 serving as a defrosting target is smaller than an airflow volume for the parallel heat exchanger 14 serving as an evaporator in the defrosting heating operation mode. The operation control unit 61*a* improves defrosting performance by individually controlling the outdoor fan 19-1 and the outdoor fan 19-2 in the defrosting heating operation mode.

For example, when the parallel heat exchanger 14-2 is a defrosting target, the operation control unit 61*a* controls the outdoor fan 19-1 and the outdoor fan 19-2 such that the airflow volume for the parallel heat exchanger 14-2 is smaller than the airflow volume for the parallel heat exchanger 14-1. In this case, the operation control unit 61*a* decreases the airflow volume for the parallel heat exchanger 14-2 by stopping the outdoor fan 19-2 or controls the outdoor fan 19-2 at a rotation speed lower than that of the outdoor fan 19-1. In this case, the operation control unit 61*a* performs control such that the outdoor fan 19-1 operates.

When the erroneous installation-sensing process is performed, the operation control unit 61*a* does not change the airflow volume of the outdoor fan 19-1 corresponding to the parallel heat exchanger 14-1 serving as an evaporator and increases the airflow volume of the outdoor fan 19-2 corresponding to the parallel heat exchanger 14-2 serving as a defrosting target.

The basic function of the erroneous installation-sensing unit 62*a* is the same as the erroneous installation-sensing unit 62 according to the first embodiment. The erroneous installation-sensing unit 62*a* senses erroneous installation of a plurality of outdoor fans (19-1 and 19-2), for example, based on change of the detected temperature before and after the airflow volume of the outdoor fan 19-1 (or the outdoor fan 19-2) for one of the parallel heat exchanger 14-2 serving as a defrosting target and the parallel heat exchanger 14-1 serving as an evaporator is changed.

For example, the erroneous installation-sensing unit 62*a* changes the outdoor fan 19-2 from stopping to operating and senses that the outdoor fan (19-1, 19-2) is erroneously installed when the detected temperature after the airflow volume for the parallel heat exchanger 14-2 serving as a defrosting target is increased is not lower than the detected temperature before the airflow volume is increased (not lower than the previous detected temperature). The erroneous installation-sensing unit 62*a* senses that the outdoor fan (19-1, 19-2) is installed normally when the detected temperature after the airflow volume for the parallel heat exchanger 14-2 serving as a defrosting target is increased is lower than the detected temperature before the airflow volume is increased.

Operations of the air-conditioning device 100*a* according to this embodiment are described below with reference to the drawings.

Figure 12:
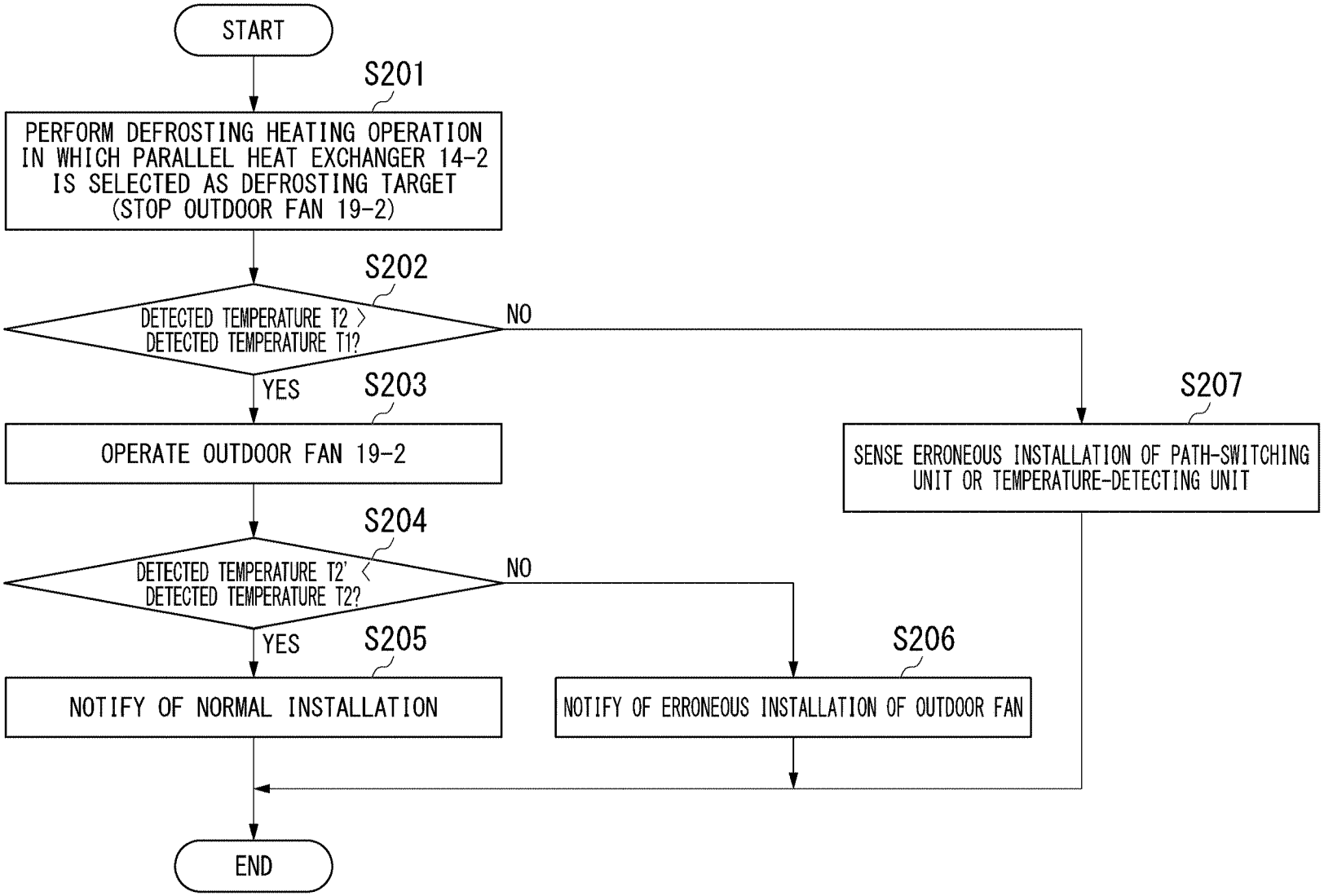
FIG. 12 is a flowchart illustrating an example of an erroneous installation-sensing process of the air-conditioning device according to the second embodiment.

FIG. 12 is a flowchart illustrating an example of the erroneous installation-sensing process in the air-conditioning device 100*a* according to this embodiment.

The air-conditioning device 100*a* performs the erroneous installation-sensing process illustrated in FIG. 12 when a starting condition of the erroneous installation-sensing process is satisfied.

As illustrated in FIG. 12, the operation control unit 61*a* of the control device 60*a* first performs the defrosting heating operation in which the parallel heat exchanger 14-2 is selected as a defrosting target (Step S201). That is, the operation control unit 61*a* sets the cooling/heating-switching unit 12 to switching B, sets the first on/off-switching device 41-1 and the second on/off-switching device 42-2 to the ON state, and sets the first on/off-switching device 41-2 and the second on/off-switching device 42-1 to the OFF state. The operation control unit 61*a* turns on the flow rate-adjusting device 18 to start the operation of the compressor 11. The operation control unit 61*a* sets the outdoor fan 19-1 to the ON state (an operating state) and sets the outdoor fan 19-2 to the OFF state (a stopped state).

Then, the erroneous installation-sensing unit 62*a* of the control device 60*a* determines whether the detected temperature T2 is higher than the detected temperature T1 (Step S202). The erroneous installation-sensing unit 62*a* determines whether the detected temperature T2 in the parallel heat exchanger 14-2 is higher than the detected temperature T1 in the parallel heat exchanger 14-1. When the detected temperature T2 is higher than the detected temperature T1 (Step S202: YES), the erroneous installation-sensing unit 62*a* causes the process to proceed to Step S203. When the detected temperature T2 is equal to or lower than the detected temperature T1 (Step S202: NO), the erroneous installation-sensing unit 62*a* causes the process to proceed to Step S207.

In Step S203, the operation control unit 61*a* operates the outdoor fan 19-2. That is, the operation control unit 61*a* sets the outdoor fan 19-2 to the ON state (the operating state).

Then, the erroneous installation-sensing unit 62*a* determines that a detected temperature T2' is lower than the detected temperature T2 (Step S204). Here, the detected temperature T2 is a detected temperature of a refrigerant detected by the temperature-detecting unit 51-2 before the outdoor fan 19-2 is switched to the ON state (when the outdoor fan 19-2 is in the OFF state). The detected temperature T2' is a detected temperature of the refrigerant detected by the temperature-detecting unit 51-2 after the outdoor fan 19-2 is switched to the ON state. The erroneous installation-sensing unit 62*a* compares the detected temperature T2 and the detected temperature T2' and causes the process to proceed to Step S205 when the detected temperature T2' is lower than the detected temperature T2 (Step S204: YES). When the detected temperature T2' is equal to or higher than the detected temperature T2 (Step S204: NO), the erroneous installation-sensing unit 62*a* causes the process to proceed to Step S206.

In Step S205, the erroneous installation-sensing unit 62*a* notifies the outside of normal installation. In this case, the erroneous installation-sensing unit 62*a* causes the notification output unit 63 to output notification information indicating that installation of the temperature-detecting unit 51 (51-1, 51-2), the flow channel-switching unit 40 (the first on/off-switching device 41-1, first on/off-switching device 41-2, the second on/off-switching device 42-1, and the second on/off-switching device 42-1), and the outdoor fan (19-1, 19-2) is normal and notifies the outside of normal installation. After the process of Step S205 is performed, the erroneous installation-sensing unit 62*a* ends the erroneous installation-sensing process.

In Step S206, the erroneous installation-sensing unit 62*a* notifies the outside of erroneous installation of the outdoor fan (19-1, 19-2). In this case, the erroneous installation-sensing unit 62*a* causes the notification output unit 63 to output notification information indicating that installation of the outdoor fan (19-1, 19-2) is erroneous and notifies the outside of erroneous installation of the outdoor fan (19-1, 19-2). After the process of Step S206 is performed, the erroneous installation-sensing unit 62*a* ends the erroneous installation-sensing process.

In Step S207, the erroneous installation-sensing unit 62*a* notifies the outside of erroneous installation of the temperature-detecting unit 51 or the flow channel-switching unit 40. In this case, the erroneous installation-sensing unit 62*a* causes the notification output unit 63 to output notification information indicating that installation of the temperature-detecting unit 51 or the flow channel-switching unit 40 is erroneous and notifies the outside of erroneous installation. After the process of Step S207 is performed, the erroneous installation-sensing unit 62*a* ends the erroneous installation-sensing process.

In the aforementioned process flow, when the outdoor fan 19-1 and the outdoor fan 19-2 are installed normally, the airflow volume for the parallel heat exchanger 14-2 increases and cooling performance of the refrigerant using air is improved by switching the outdoor fan 19-2 to the ON state, and the temperature detected by the temperature-detecting unit 51-2 decreases. Accordingly, the erroneous installation-sensing unit 62*a* switches the outdoor fan 19-2 from the OFF state to the ON state and determines that the outdoor fan 19-1 and the outdoor fan 19-2 are installed normally when the detected temperature T2' after the outdoor fan 19-2 is switched to the ON state is lower than the detected temperature T2 before the outdoor fan 19-2 is switched to the ON state (when the outdoor fan 19-2 is in the OFF state).

In the process of Step S204 in FIG. 12, the erroneous installation-sensing unit 62*a* determines whether the outdoor fan 19-1 and the outdoor fan 19-2 are installed normally by comparing the detected temperature T2 and the detected temperature T2' detected by the temperature-detecting unit 51-2, but the temperature detected by the temperature-detecting unit 51-1 may be used.

Figure 13:
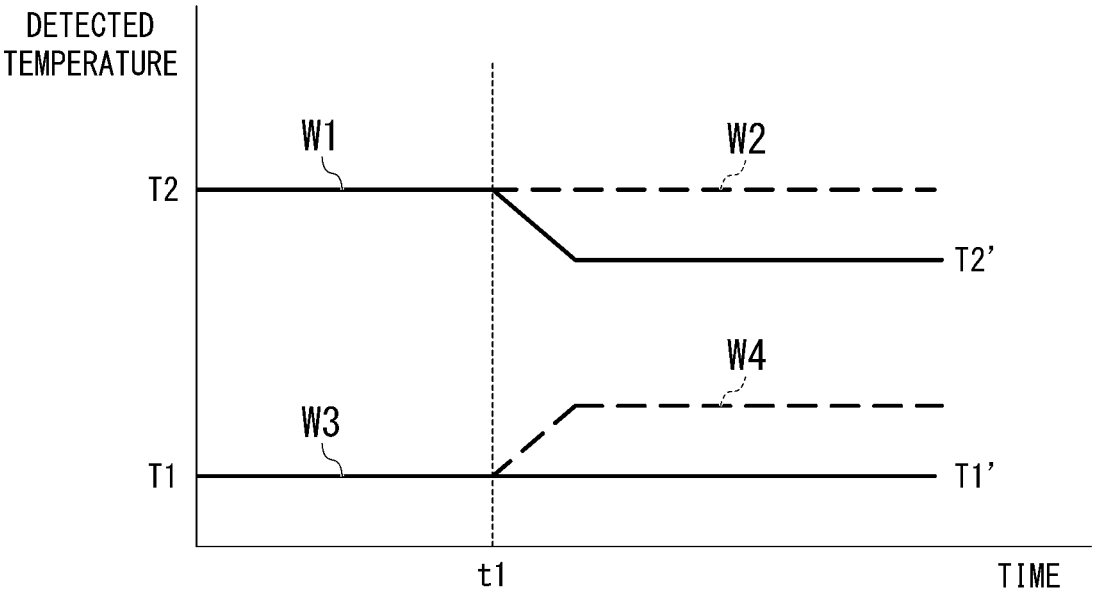
FIG. 13 is a drawing illustrating an example of change in detected temperature in the erroneous installation-sensing process of the air-conditioning device according to the second embodiment.

FIG. 13 is a drawing schematically illustrating change of a detected temperature with time in the erroneous installation-sensing process according to this embodiment.

In FIG. 13, the vertical axis represents the detected temperature, and the horizontal axis represents the time. In a waveform W1 and a waveform W3, for example, change of the detected temperature in normal installation when the outdoor fan 19-2 is switched from the OFF state to the ON state at time t1 is indicated by a solid line. In a waveform W2 and a waveform W4, change of the detected temperature in erroneous installation when the outdoor fan (19-1, 19-2) is erroneously installed is indicated by a dashed line.

In the case of normal installation, since the temperature detected by the temperature-detecting unit 51-2 connected to the parallel heat exchanger 14-2 corresponding to the outdoor fan 19-2 changes, the detected temperature T2' is lower than the detected temperature T2 (see the waveform W1). At this time, the temperature detected by the temperature-detecting unit 51-1 does not change and the detected temperature T1' detected by the temperature-detecting unit 51-2 after the outdoor fan 19-2 is switched to the ON state does not change from the detected temperature T1 (see the waveform W3).

On the other hand, when the outdoor fan 19-1 and the outdoor fan 19-2 are erroneously installed, the outdoor fan 19-2 corresponds to the parallel heat exchanger 14-1 and thus the temperature detected by the temperature-detecting unit 51-1 changes. In this case, since the airflow volume for the parallel heat exchanger 14-1 serving as an evaporator increases and heating performance of the refrigerant using air is improved, the temperature detected by the temperature-detecting unit 51-1 increases and the detected temperature T1' is higher than the detected temperature T1 (see the waveform W4).

Accordingly, in the process of Step S204 illustrated in FIG. 12, the erroneous installation-sensing unit 62*a* may sense that the outdoor fan (19-1, 19-2) is erroneously installed when the detected temperature T1' is higher than the detected temperature T1.

The outdoor fan 19-2 is switched to the OFF state in the process of Step S201 and is switched to the ON state in the process of Step S203, but the outdoor fan 19-2 may be made to operate at a lower rotation speed in the process of Step S201 and the rotation speed of the outdoor fan 19-2 may be increased in the process of Step S203.

In the process of Step S203, the rotation speed of the outdoor fan 19-1 may be decreased instead of switching of the outdoor fan 19-2 to the ON state or increasing the rotation speed thereof. In this case, in the process of Step S204, the erroneous installation-sensing unit 62*a* determines normal installation when the detected temperature T1' is lower than the detected temperature T1 or determines erroneous installation when the detected temperature T2' is higher than the detected temperature T2.

As described above, the air-conditioning device 100*a* according to this embodiment includes a plurality of air blowers (the outdoor fan 19-1 and the outdoor fan 19-2) that blow air to a plurality of parallel heat exchangers 14. The erroneous installation-sensing unit 62*a* senses erroneous installation of a plurality of air blowers (the outdoor fan 19-1 and the outdoor fan 19-2) based on a change of the detected temperature before and after the airflow volume of the air blower (the outdoor fan 19-1 or the outdoor fan 19-2) for one of the parallel heat exchanger 14 serving as a defrosting target and the parallel heat exchanger 14 serving as an evaporator is changed.

Accordingly, the air-conditioning device 100*a* according to this embodiment can appropriately sense erroneous installation of a plurality of air blowers (the outdoor fan 19-1 and the outdoor fan 19-2).

In this embodiment, the operation control unit 61*a* does not change the airflow volume of the air blower (the outdoor fan 19-1) corresponding to the parallel heat exchanger 14 (for example, the parallel heat exchanger 14-1) serving as an evaporator but increases the airflow volume of the air blower (the outdoor fan 19-2) corresponding to the parallel heat exchanger 14 (for example, the parallel heat exchanger 14-2) serving as a defrosting target. The erroneous installation-sensing unit 62*a* senses that the plurality of air blowers (the outdoor fan 19-1 and the outdoor fan 19-2) are erroneously installed when the detected temperature T2' after the airflow volume for the parallel heat exchanger 14 serving as a defrosting target (for example, the parallel heat exchanger 14-2) is increased is not lower than the detected temperature T2 before the airflow volume is increased.

Accordingly, the air-conditioning device 100*a* according to this embodiment can appropriately sense erroneous installation of the plurality of air blowers (the outdoor fan 19-1 and the outdoor fan 19-2) by increasing the airflow volume of the air blower (the outdoor fan 19-2) corresponding to the parallel heat exchanger 14 serving as a defrosting target (for example, the parallel heat exchanger 14-2).

In this embodiment, the operation control unit 61*a* does not change the airflow volume of the air blower (the outdoor fan 19-1) corresponding to the parallel heat exchanger 14 serving as an evaporator (for example, the parallel heat exchanger 14-1) but increases the airflow volume of the air blower (the outdoor fan 19-2) corresponding to the parallel heat exchanger 14 serving as a defrosting target (for example, the parallel heat exchanger 14-2). The erroneous installation-sensing unit 62*a* senses that the plurality of air blowers (the outdoor fan 19-1 and the outdoor fan 19-2) are erroneously installed when the detected temperature T1' after the airflow volume for the parallel heat exchanger 14 serving as a defrosting target (for example, the parallel heat exchanger 14-2) is increased is higher than the detected temperature T1 before the airflow volume is increased.

Accordingly, the air-conditioning device 100*a* according to this embodiment can appropriately sense erroneous installation of the plurality of air blowers (the outdoor fan 19-1 and the outdoor fan 19-2) by increasing the airflow volume of the air blower (the outdoor fan 19-2) corresponding to the parallel heat exchanger 14 serving as a defrosting target (for example, the parallel heat exchanger 14-2).

In this embodiment, the operation control unit 61*a* controls the plurality of air blowers (the outdoor fan 19-1 and the outdoor fan 19-2) such that the airflow volume for the parallel heat exchanger 14 serving as a defrosting target (for example, the parallel heat exchanger 14-2) is smaller than the airflow volume for the parallel heat exchanger 14 serving as an evaporator (for example, the parallel heat exchanger 14-1) in the defrosting heating operation mode.

Accordingly, with the air-conditioning device 100*a* according to this embodiment, since the airflow volume for the parallel heat exchanger 14 serving as a defrosting target (for example, the parallel heat exchanger 14-2) decreases, it is possible to suppress dissipation of heat from a high-temperature refrigerant used for defrosting to air and to efficiently transmit heat of the refrigerant to frost. Accordingly, with the air-conditioning device 100*a* according to this embodiment, it is possible to improve defrosting performance by individually operating the outdoor fan 19-1 and the outdoor fan 19-2 in the defrosting heating operation mode.

Third Embodiment

An air-conditioning device 100*b* according to a third embodiment of the present disclosure are described below with reference to the drawings.

Figure 14:
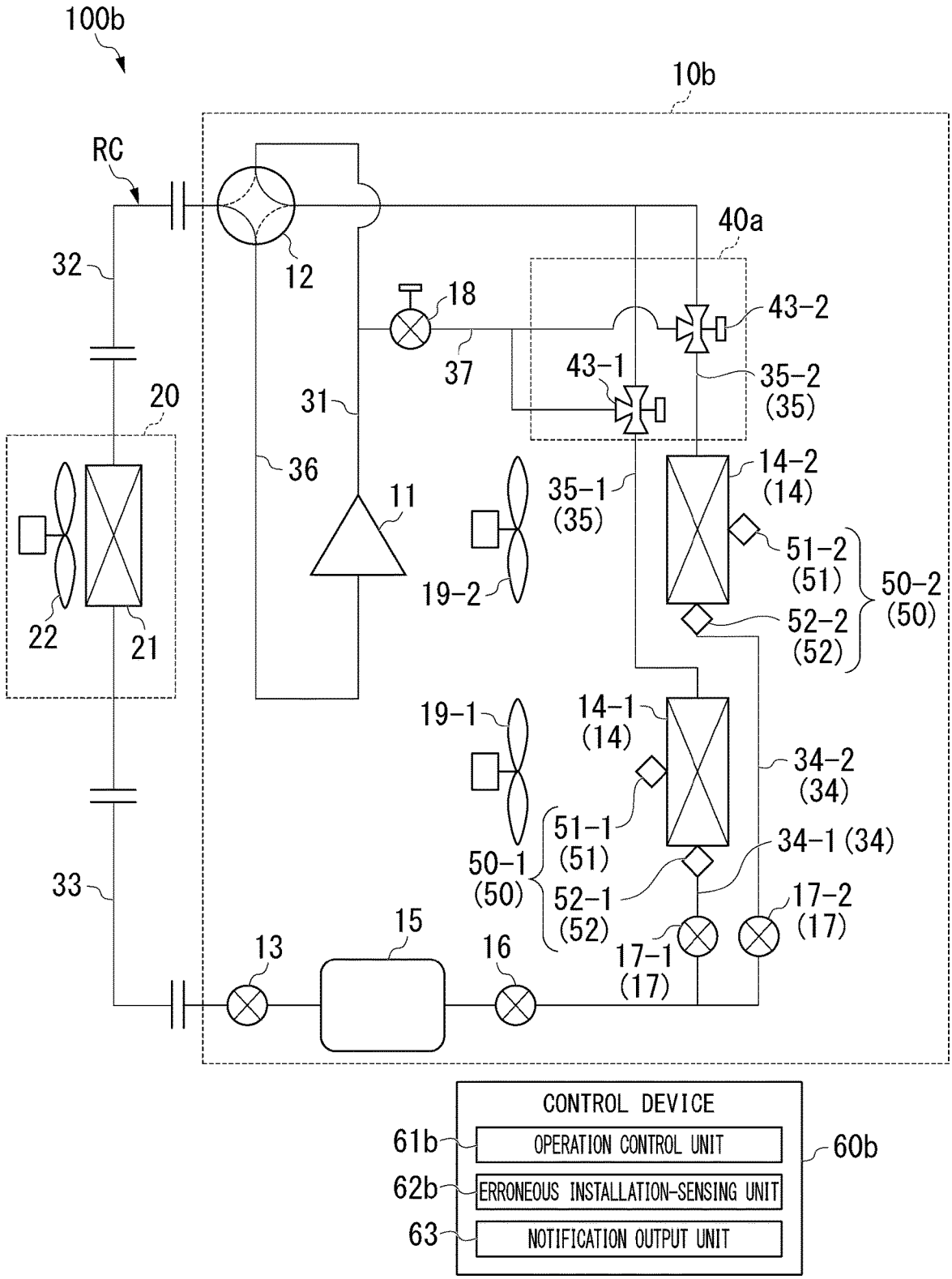
FIG. 14 is a drawing illustrating an example of a configuration of an air-conditioning device according to a third embodiment.

FIG. 14 is a drawing illustrating an example of a configuration of the air-conditioning device 100*b* according to the third embodiment.

As illustrated in FIG. 14, the air-conditioning device 100*b* includes an outdoor unit 10*b*, an indoor unit 20, and a control device 60*b*.

In FIG. 14, the same elements as in FIG. 1 or FIG. 11 are referred to by the same reference signs and description thereof are omitted. In the following description, differences of the air-conditioning device 100*b* from the first embodiment and the second embodiment are mainly described.

The outdoor unit 10*b* includes a compressor 11, a cooling/heating-switching unit 12, a first decompressor 13, a plurality of parallel heat exchangers 14 (14-1 and 14-2), a receiver 15, a third decompressor 16, a plurality of second decompressors 17 (17-1 and 17-2), a flow rate-adjusting device 18, a plurality of outdoor fans (19-1 and 19-2), a flow channel-switching unit 40*a*, a plurality of temperature-detecting units 51 (51-1 and 51-2), and a plurality of temperature-detecting units 52 (52-1 and 52-2). The outdoor unit 10*b* is different from the outdoor unit 10*a* according to the second embodiment in that the flow channel-switching unit 40*a* has a different configuration and the plurality of temperature-detecting units 52 (52-1 and 52-2) are provided.

In this embodiment, the temperature-detecting unit 51-1 and the temperature-detecting unit 52-1 are used as temperature-detecting units 50-1 that detect the temperature of a refrigerant in the parallel heat exchanger 14-1, and the temperature-detecting unit 51-2 and the temperature-detecting unit 52-2 are used as temperature-detecting units 50-2 that detect the temperature of a refrigerant in the parallel heat exchanger 14-2.

In this embodiment, each of the temperature-detecting unit 51-1 and the temperature-detecting unit 51-2 is an example of a first temperature-detecting unit, and each of the temperature-detecting unit 52-1 and the temperature-detecting unit 52-2 is an example of a second temperature-detecting unit. The temperature-detecting unit 51-1 and the temperature-detecting unit 51-2 are referred to as temperature-detecting units 51 when they represent arbitrary first temperature-detecting units provided in the air-conditioning device 100*b* or when they are not particularly distinguished.

The temperature-detecting unit 52-1 and the temperature-detecting unit 52-2 are referred to as temperature-detecting units 52 when they represent arbitrary second temperature-detecting units provided in the air-conditioning device 100*b* or when they are not particularly distinguished. The temperature-detecting unit 50-1 and the temperature-detecting unit 50-2 are referred to as temperature-detecting units 50 when they represent arbitrary temperature-detecting units provided in the air-conditioning device 100*b* or when they are not particularly distinguished.

The temperature-detecting unit 51 detects the saturation temperature of the refrigerant in the parallel heat exchanger 14 as the first detected temperature. That is, the temperature-detecting unit 51-1 detects the saturation temperature of the refrigerant in the parallel heat exchanger 14-1 as a detected temperature T11. The temperature-detecting unit 51-2 detects the saturation temperature of the refrigerant in the parallel heat exchanger 14-2 as a detected temperature T12.

The temperature-detecting unit 52 is disposed in a pipe (the first connection pipe 34) connected to the opposite side of the bypass pipe 37 with respect to the parallel heat exchanger 14 and detects the temperature of the refrigerant at an outlet of the parallel heat exchanger 14 serving as a defrosting target as the second detected temperature. That is, the temperature-detecting unit 52-1 detects the temperature of the refrigerant in a part of the parallel heat exchanger 14-1 corresponding to the first connection pipe 34-1 as a detected temperature T21. The temperature-detecting unit 52-2 detects the temperature of the refrigerant in a part of the parallel heat exchanger 14-2 corresponding to the first connection pipe 34-2 as a detected temperature T22. As long as the temperature of the refrigerant at an outlet when the parallel heat exchanger 14 is selected as a defrosting target can be detected, the temperature-detecting unit 52 is not limited to be disposed in the first connection pipe 34 and may be disposed in the vicinity of the outlet of the parallel heat exchanger 14.

The flow channel-switching unit 40*a* is connected to two parallel heat exchangers 14 and selects one parallel heat exchanger 14 of the two parallel heat exchangers 14 as a defrosting target. The flow channel-switching unit 40*a* is disposed in the second connection pipe 35 (35-1, 35-2) between the emission side (the cooling/heating-switching unit 12 side) of the compressor 11 and the two parallel heat exchangers 14 (14-1 and 14-2).

The flow channel-switching unit 40*a* includes a switching device 43-1 and a switching device 43-2.

The switching device 43-1 is, for example, a three-way valve or a four-way valve. The switching device 43-1 switches a pipe connected to the parallel heat exchanger 14-1 between the intake pipe 36 and the bypass pipe 37.

The switching device 43-2 is, for example, a three-way valve or a four-way valve. The switching device 43-2 switches a pipe connected to the parallel heat exchanger 14-2 between the intake pipe 36 and the bypass pipe 37.

In this embodiment, the switching device 43-1 and the switching device 43-2 are referred to as switching devices 43 when they are arbitrary switching devices provided in the air-conditioning device 100*b* or when they are not particularly distinguished.

The control device 60*b* includes, for example, a CPU and controls operations of various control units and switching of an operation mode. The control device 60*b* includes, for example, control boards installed in the outdoor unit 10*b* and the indoor unit 20 and a remote controller grounded indoors.

The control device 60*b* includes an operation control unit 61*b*, an erroneous installation-sensing unit 62*b*, and a notification output unit 63.

The basic function of the operation control unit 61*b* is the same as the operation control unit 61*a* according to the second embodiment. The operation control unit 61*b* switches the operation mode between the normal heating operation mode and the defrosting heating operation mode by operating the flow channel-switching unit 40*a*. The operation control unit 61*b* switches a pipe to be connected to the parallel heat exchanger 14-1 between the intake pipe 36 and the bypass pipe 37 by operating the switching device 43-1. The operation control unit 61*b* switches a pipe to be connected to the parallel heat exchanger 14-2 between the intake pipe 36 and the bypass pipe 37 by operating the switching device 43-2.

States of the cooling/heating-switching unit 12 and the flow channel-switching unit 40*a* corresponding to the operation modes of the air-conditioning device 100*b* are described below with reference to FIG. 15.

FIG. 15 is a drawing illustrating states of the cooling/heating-switching unit 12 and the flow channel-switching unit 40*a* corresponding to the operation modes of the air-conditioning device 100*b* according to this embodiment.

In FIG. 15, in the switching device 43-1 and the switching device 43-2 of the flow channel-switching unit 40*a*, "main circuit" state represents a state in which the parallel heat exchanger 14 is connected to the intake pipe 36, and "bypass" state represents a state in which the parallel heat exchanger 14 is connected to the bypass pipe 37.

For example, when the operation is the cooling operation mode, the operation control unit 61*b* sets the cooling/heating-switching unit 12 to "switching A" and sets the switching device 43-1 and the switching device 43-2 to "main circuit" state.

For example, when the operation mode is the normal heating operation mode, the operation control unit 61*b* sets the cooling/heating-switching unit 12 to "switching B" and sets the switching device 43-1 and the switching device 43-2 to "main circuit" state.

For example, when the operation mode is the defrosting heating operation mode and the path 1 side is selected as a defrosting target (in the case of "path 1-side defrosting"), the operation control unit 61*b* sets the cooling/heating-switching unit 12 to "switching B." In this case, the operation control unit 61*b* sets the switching device 43-1 to "bypass" and sets the switching device 43-2 to "main circuit" state.

For example, when the operation mode is the defrosting heating operation mode and the path 2 side is selected as a defrosting target (in the case of "path 2-side defrosting"), the operation control unit 61*b* sets the cooling/heating-switching unit 12 to "switching B." In this case, the operation control unit 61*b* sets the switching device 43-1 to "main circuit" state and sets the switching device 43-2 to "bypass" state.

The basic function of the erroneous installation-sensing unit 62*b* is the same as the erroneous installation-sensing unit 62*a* according to the second embodiment. The erroneous installation-sensing unit 62*b* senses erroneous installation of an installed component associated with defrosting. In this embodiment, examples of the installed component associated with defrosting include the flow channel-switching unit 40*a*, the temperature-detecting unit 51, the temperature-detecting unit 52, and the outdoor fan (19-1, 19-2).

The erroneous installation-sensing unit 62*b* determines whether one of the flow channel-switching unit 40*a*, the temperature-detecting unit 51, the temperature-detecting unit 52, and the outdoor fan (19-1, 19-2) is erroneously installed, for example, based on a combination of four detected temperatures including the detected temperature T12 and the detected temperature T22 in the parallel heat exchanger 14-2 serving as a defrosting target and the detected temperature T11 and the detected temperature T21 in the parallel heat exchanger 14-1 serving as an evaporator.

Operations of the air-conditioning device 100*b* according to this embodiment are described below with reference to the drawings.

Figure 16:
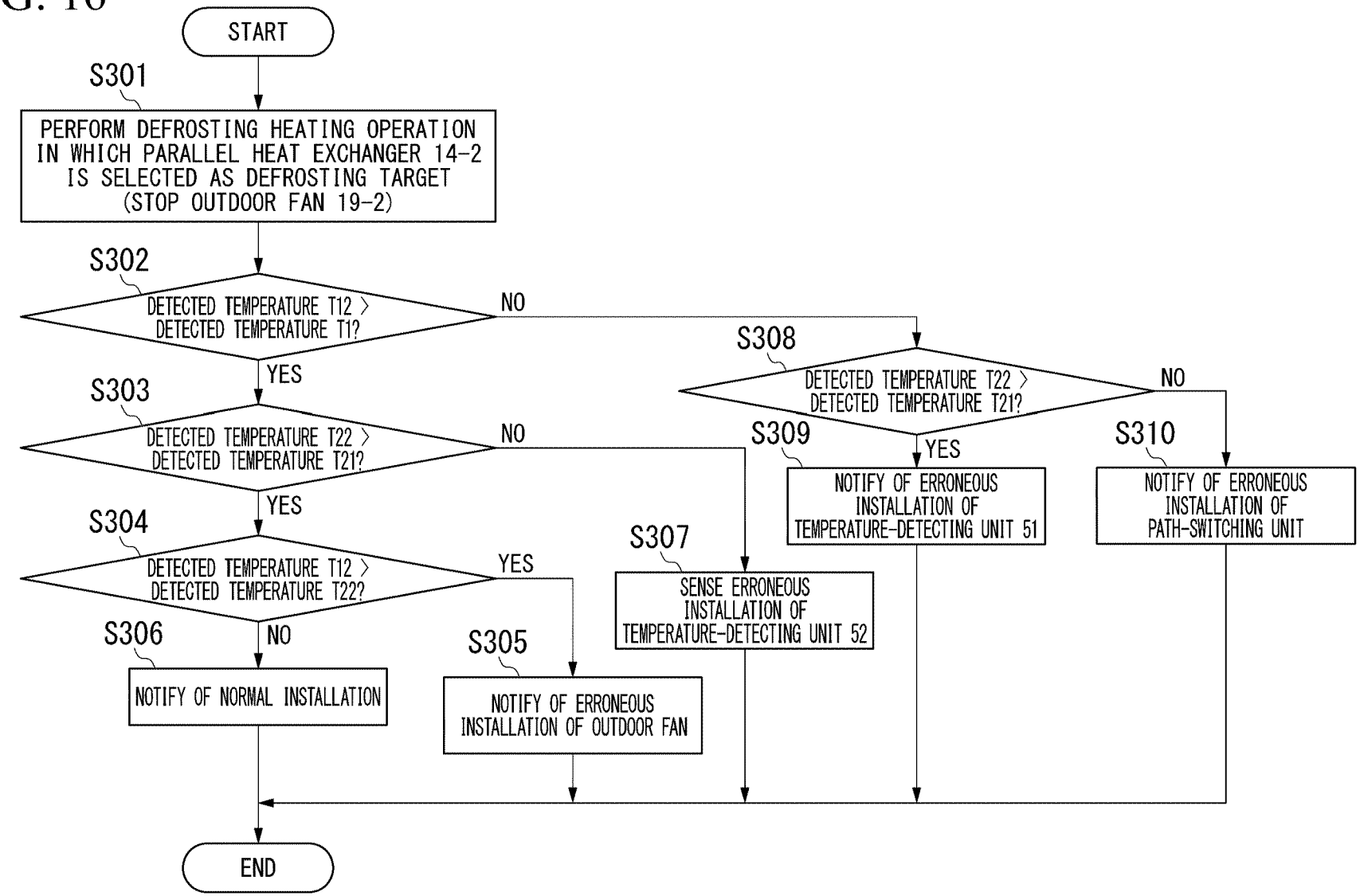
FIG. 16 is a flowchart illustrating an example of an erroneous installation-sensing process of the air-conditioning device according to the third embodiment.

FIG. 16 is a flowchart illustrating an example of the erroneous installation-sensing process in the air-conditioning device 100*b* according to this embodiment.

The air-conditioning device 100*b* performs the erroneous installation-sensing process illustrated in FIG. 16 when a starting condition of the erroneous installation-sensing process is satisfied.

As illustrated in FIG. 16, the operation control unit 61*b* of the control device 60*b* first performs the defrosting heating operation in which the parallel heat exchanger 14-2 is selected as a defrosting target (Step S301). That is, as illustrated in FIG. 15, the operation control unit 61*b* sets the cooling/heating-switching unit 12 to "switching B," sets the switching device 43-1 to "main circuit" state, and sets the switching device 43-2 to "bypass" state. The operation control unit 61*b* turns on the flow rate-adjusting device 18 to start the operation of the compressor 11. The operation control unit 61*b* sets the outdoor fan 19-1 to the ON state (an operating state) and sets the outdoor fan 19-2 to the OFF state (a stopped state).

Then, the erroneous installation-sensing unit 62*b* of the control device 60*b* determines whether the detected temperature T12 is higher than the detected temperature T11 (Step S302). The erroneous installation-sensing unit 62*b* determines whether the detected temperature T12 detected by the temperature-detecting unit 51-2 is higher than the detected temperature T11 detected by the temperature-detecting unit 51-1. When the detected temperature T12 is higher than the detected temperature T11 (Step S302: YES), the erroneous installation-sensing unit 62*b* causes the process to proceed to Step S303. When the detected temperature T12 is equal to or lower than the detected temperature T11 (Step S302: NO), the erroneous installation-sensing unit 62*b* causes the process to proceed to Step S308.

In Step S303, the erroneous installation-sensing unit 62*b* determines whether the detected temperature T22 is higher than the detected temperature T21. The erroneous installation-sensing unit 62*b* determines whether the detected temperature T22 detected by the temperature-detecting unit 52-2 is higher than the detected temperature T21 detected by the temperature-detecting unit 52-1. When the detected temperature T22 is higher than the detected temperature T21 (Step S303: YES), the erroneous installation-sensing unit 62*b* causes the process to proceed to Step S304. When the detected temperature T22 is equal to or lower than the detected temperature T21 (Step S303: NO), the erroneous installation-sensing unit 62*b* causes the process to proceed to Step S307.

In Step S304, the erroneous installation-sensing unit 62*b* determines whether the detected temperature T12 is higher than the detected temperature T22. The erroneous installation-sensing unit 62*b* determines whether the detected temperature T12 detected by the temperature-detecting unit 51-2 is higher than the detected temperature T22 detected by the temperature-detecting unit 52-2. When the detected temperature T12 is higher than the detected temperature T22 (Step S304: YES), the erroneous installation-sensing unit 62*b* causes the process to proceed to Step S305. When the detected temperature T12 is equal to or lower than the detected temperature T22 (Step S304: NO), the erroneous installation-sensing unit 62*b* causes the process to proceed to Step S306.

In Step S305, the erroneous installation-sensing unit 62*b* notifies the outside that the outdoor fans (19-1 and 19-2) are erroneously installed. In this case, the erroneous installation-sensing unit 62*b* causes the notification output unit 63 to output notification information indicating that installation of the outdoor fans (19-1, 19-2) is erroneous and notifies the outside that the outdoor fans (19-1, 19-2) are erroneously installed. After the process of Step S305 is performed, the erroneous installation-sensing unit 62*b* ends the erroneous installation-sensing process.

In Step S306, the erroneous installation-sensing unit 62*b* notifies the outside of normal installation. In this case, the erroneous installation-sensing unit 62*b* causes the notification output unit 63 to output notification information indicating that installation of the flow channel-switching unit 40*a*, the temperature-detecting unit 51, the temperature-detecting unit 52, and the outdoor fans (19-1, 19-2) is normal and notifies the outside of normal installation. After the process of Step S306 is performed, the erroneous installation-sensing unit 62*b* ends the erroneous installation-sensing process.

In Step S307, the erroneous installation-sensing unit 62*b* notifies the outside that the temperature-detecting unit 51 is erroneously installed. In this case, the erroneous installation-sensing unit 62*b* causes the notification output unit 63 to output notification information indicating that installation of the temperature-detecting units 51 (51-1 and 51-2) is erroneous and notifies the outside that the temperature-detecting units 51 (51-1 and 51-2) are erroneously installed. After the process of Step S307 is performed, the erroneous installation-sensing unit 62*b* ends the erroneous installation-sensing process.

In Step S308, the erroneous installation-sensing unit 62*b* determines whether the detected temperature T22 is higher than the detected temperature T21. The erroneous installation-sensing unit 62*b* determines whether the detected temperature T22 detected by the temperature-detecting unit 52-2 is higher than the detected temperature T21 detected by the temperature-detecting unit 52-1. When the detected temperature T22 is higher than the detected temperature T21 (Step S308: YES), the erroneous installation-sensing unit 62*b* causes the process to proceed to Step S309. When the detected temperature T22 is equal to or lower than the detected temperature T21 (Step S308: NO), the erroneous installation-sensing unit 62*b* causes the process to proceed to Step S310.

In Step S309, the erroneous installation-sensing unit 62*b* notifies the outside that the temperature-detecting unit 52 is erroneously installed. In this case, the erroneous installation-sensing unit 62*b* causes the notification output unit 63 to output notification information indicating that installation of the temperature-detecting units 52 (52-1 and 52-2) is erroneous and notifies the outside that the temperature-detecting units 52 (52-1 and 52-2) are erroneously installed. After the process of Step S309 is performed, the erroneous installation-sensing unit 62*b* ends the erroneous installation-sensing process.

In Step S310, the erroneous installation-sensing unit 62*b* notifies the outside that the flow channel-switching unit 40*a* is erroneously installed. In this case, the erroneous installation-sensing unit 62*b* causes the notification output unit 63 to output notification information indicating that installation of the flow channel-switching unit 40*a* (the switching device 43-1 and the switching device 43-2) is erroneous and notifies the outside that the flow channel-switching unit 40*a* (the switching device 43-1 and the switching device 43-2) is erroneously installed. After the process of Step S310 is performed, the erroneous installation-sensing unit 62*b* ends the erroneous installation-sensing process.

The determination of erroneous installation in Steps S302 to S304 are described below in detail.

First, when the flow channel-switching unit 40*a* (the switching device 43-1 and the switching device 43-2), the temperature-detecting units 51 (51-1 and 51-2), and the temperature-detecting units 52 (52-1 and 52-2) are installed normally, the temperature-detecting unit 51-1 and the temperature-detecting unit 52-1 detect the temperature of the parallel heat exchanger 14-1 serving as an evaporator and thus the detected temperature T11 and the detected temperature T21 are low.

The temperature-detecting unit 52-1 and the temperature-detecting unit 52-2 detect the temperature of the parallel heat exchanger 14-2 into which emitted gas flows, and thus the detected temperature T21 and the detected temperature T22 are high. From this point of view, the erroneous installation-sensing unit 62*b* can ascertain that the flow channel-switching unit 40*a* and the temperature-detecting units 51 are installed normally because the detected temperature T12 is higher than the detected temperature T11 in Step S302. The erroneous installation-sensing unit 62*b* can ascertain that the temperature-detecting units 52 are installed normally because the detected temperature T22 is higher than the detected temperature T21 in Step S303.

When it is determined in Step S303 that the detected temperature T22 is equal to or lower than the detected temperature T21, the erroneous installation-sensing unit 62*b* can determine that the detected temperature T22 is the temperature in the parallel heat exchanger 14-1 serving as an evaporator and ascertain that the temperature-detecting units 52 are erroneously installed.

When the outdoor fan 19-1 and the outdoor fan 19-2 are installed normally, the emitted gas flowing into the parallel heat exchanger 14-2 is cooled with air, but the outdoor fan 19-2 corresponding to the parallel heat exchanger 14-2 is in the OFF state, and thus the cooling performance is low and supercooling is not reached. Accordingly, the detected temperature T22 is the same saturation temperature as the detected temperature T12.

When the outdoor fan 19-1 and the outdoor fan 19-2 are erroneously installed, the outdoor fan 19-1 corresponding to the parallel heat exchanger 14-2 is in the ON state, and thus the cooling performance is improved and supercooling is reached. Accordingly, the detected temperature T22 is detected as the supercooling temperature, and thus the detected temperature T22 is lower than the detected temperature T12, which is detected as the saturation temperature. Accordingly, the erroneous installation-sensing unit 62*b* can sense erroneous installation of the outdoor fan 19-1 and the outdoor fan 19-2 by comparing the detected temperature T12 and the detected temperature T22 in Step S304.

When the erroneous installation-sensing unit 62*b* determines in Step S302 that the detected temperature T12 is equal to or lower than the detected temperature T11, it means that any of the switching device 43-1 and the switching device 43-2 and the temperature-detecting unit 51-1 and the temperature-detecting unit 51-2 is erroneously installed. Accordingly, the erroneous installation-sensing unit 62*b* can compare the detected temperature T21 and the detected temperature T22 in Step S308 and sense that the temperature-detecting units 51 (51-1 and 51-2) are erroneously installed when the detected temperature T22 is higher than the detected temperature T21.

When it is determined in Step S310 that the detected temperature T22 is equal to or lower than the detected temperature T21, the erroneous installation-sensing unit 62*b* can sense that the flow channel-switching unit 40*a* (the switching device 43-1 and the switching device 43-2) are erroneously installed.

When the temperature-detecting units 51 (51-1 and 51-2) are erroneously installed, the parallel heat exchanger 14-1 serves as an evaporator and the emitted gas flows into the parallel heat exchanger 14-2. Accordingly, the temperature-detecting unit 51-2 connected to the parallel heat exchanger 14-1 detects a low temperature and the temperature-detecting unit 51-1 connected to the parallel heat exchanger 14-2 detects a high temperature.

When the temperature-detecting units 52 (52-1 and 52-2) are installed normally, the temperature-detecting unit 52-1 connected to the parallel heat exchanger 14-1 detects a low temperature and the temperature-detecting unit 52-2 connected to the parallel heat exchanger 14-2 detects a high temperature. Accordingly, since it is determined in Step S302 that the detected temperature T12 is equal to or lower than the detected temperature T11 and it is determined in Step S308 that the detected temperature T22 is higher than the detected temperature T21, the erroneous installation-sensing unit 62*b* can sense erroneous installation of the temperature-detecting units 51 (51-1 and 51-2).

When the flow channel-switching unit 40*a* (the switching device 43-1 and the switching device 43-2) is erroneously installed, the emitted gas flows into the parallel heat exchanger 14-1 and the parallel heat exchanger 14-2 serves as an evaporator. Accordingly, the temperature-detecting unit 51-1 and the temperature-detecting unit 52-1 connected to the parallel heat exchanger 14-1 detect a high temperature and the temperature-detecting unit 51-2 and the temperature-detecting unit 52-2 connected to the parallel heat exchanger 14-2 detect a low temperature.

Accordingly, since it is determined in Step S302 that the detected temperature T12 is equal to or lower than the detected temperature T11 and it is determined in Step S308 that the detected temperature T22 is equal to or lower than the detected temperature T21, the erroneous installation-sensing unit 62*b* can sense erroneous installation of the flow channel-switching unit 40*a* (the switching device 43-1 and the switching device 43-2).

As described above, the air-conditioning device 100*b* according to this embodiment includes the temperature-detecting unit 50 configured to detect the temperatures of the refrigerants in a plurality of parallel heat exchangers 14, the operation control unit 61*b*, and the erroneous installation-sensing unit 62*b*. The temperature-detecting unit 50 includes the temperature-detecting unit 51 (the first temperature-detecting unit) and the temperature-detecting unit 52 (the second temperature-detecting unit). The temperature-detecting unit 51 detects the saturation temperature of the refrigerant in each of the parallel heat exchangers 14 as the first detected temperature. The temperature-detecting unit 52 is disposed in the pipe connected to the opposite side to the bypass pipe 37 of each of the parallel heat exchangers 14 and detects the temperature of the refrigerant at the outlet of the parallel heat exchanger 14 serving as a defrosting target as the second detected temperature. The erroneous installation-sensing unit 62*b* determines whether one of the flow channel-switching unit 40, the temperature-detecting unit 51, the temperature-detecting unit 52, and the plurality of air blowers (the outdoor fan 19-1 and the outdoor fan 19-2) is erroneously installed, based on a combination of four detected temperatures including the first detected temperature and the second detected temperature in the parallel heat exchanger 14 serving as a defrosting target and the first detected temperature and the second detected temperature in the parallel heat exchanger 14 serving as an evaporator. That is, the erroneous installation-sensing unit 62*b* determines whether one of the flow channel-switching unit 40, the temperature-detecting unit 51, the temperature-detecting unit 52, and the plurality of air blowers (the outdoor fan 19-1 and the outdoor fan 19-2) is erroneously installed, for example, based on a combination of the detected temperature T21 and the detected temperature T22 in the parallel heat exchanger 14-2 serving as a defrosting target and the detected temperature T11 and the detected temperature T12 in the parallel heat exchanger 14-1 serving as an evaporator.

Accordingly, the air-conditioning device 100*b* according to this embodiment can appropriately sense whether one of the flow channel-switching unit 40, the temperature-detecting unit 51, the temperature-detecting unit 52, and the plurality of air blowers (the outdoor fan 19-1 and the outdoor fan 19-2) is erroneously installed. Accordingly, the air-conditioning device 100*b* according to this embodiment can appropriately sense erroneous installation of an installed component associated with defrosting and perform defrosting normally without stopping heating of the indoor unit 20.

The present disclosure is not limited to the above described embodiments, and can be modified without departing from the scope of the present disclosure.

For example, in the aforementioned embodiments, the refrigerant used in the main circuit RC is a Freon refrigerant or an HFO refrigerant, but the present disclosure is not limited thereto. The refrigerant used in the main circuit RC may be, for example, a $CO_2$ refrigerant, an HC refrigerant (for example, a propane refrigerant or an isobutene refrigerant), an ammonia refrigerant, or a mixed refrigerant thereof. The refrigerant used in the main circuit RC may be a refrigerant used for a vapor compression type heat pump.

In the aforementioned embodiments, an example in which one indoor unit 20 is connected to one outdoor unit 10 (10*a*, 10*b*) in the air-conditioning device 100 (100*a*, 100*b*) is described, but the present disclosure is not limited thereto. The air-conditioning device 100 (100*a*, 100*b*) may have, for example, a configuration in which two or more indoor units 20 are connected in parallel or a configuration in which two or more outdoor units 10 (10*a*, 10*b*) are connected in parallel. When two or more indoor units 20 are provided, the air-conditioning device 100 (100*a*, 100*b*) may have a refrigerant circuit configuration that can perform a cooling/heating simultaneous operation in which each indoor unit can selectively performs cooling or heating, by connecting three extension pipes in parallel or providing a switching device on the indoor unit 20 side.

In the aforementioned embodiments, an example in which the air-conditioning device 100 (100*a*, 100*b*) includes the receiver 15 and the third decompressor 16 is described, but a configuration in which the receiver 15 and the third decompressor 16 are not provided may be employed. An example in which the outdoor unit 10 (10*a*, 10*b*) includes the first decompressor 13 is described above, but the present disclosure is not limited thereto and the first decompressor 13 may be disposed outside of the outdoor unit 10 (10*a*, 10*b*). For example, the first decompressor 13 may be disposed in a pipe connected to the second extension pipe 33 of the indoor unit 20.

In the aforementioned embodiments, the parallel heat exchangers 14 (14-1 and 14-2) are not limited to the structure illustrated in FIG. 2, and may have another structure. For example, the parallel heat exchanger 14-1 and the parallel heat exchanger 14-2 may include a mechanism for reducing heat leakage provided in the fin 14*b* (for example, a notch or a slit provided in a fin), or a heat transfer tube for allowing a high-temperature refrigerant to flow may be provided between the parallel heat exchanger 14-1 and the parallel heat exchanger 14-2. By splitting the fin 14*b* or providing a mechanism for reducing heat leakage in the parallel heat exchanger 14-1 and the parallel heat exchanger 14-2 and providing a heat transfer tube for allowing a high-temperature refrigerant to flow, it is possible to suppress leakage of heat from the parallel heat exchanger 14 serving as a defrosting target to the parallel heat exchanger 14 serving as an evaporator and to suppress difficulty in defrosting at the boundary of the split due to leakage of heat.

In the aforementioned embodiments, an example in which the outdoor unit 10 (10*a*, 10*b*) includes two parallel heat exchangers 14 is described, but three or more parallel heat exchangers 14 may be provided.

In the aforementioned embodiments, an example in which the outdoor unit 10 (10*a*, 10*b*) includes the flow rate-adjusting device 18 is described, but a configuration in which the flow rate-adjusting device 18 is not provided may be employed. When the flow rate-adjusting device 18 is not provided, the second on/off-switching device 42-1 and the second on/off-switching device 42-2 of the flow channel-switching unit 40 or the switching device 43-1 and the switching device 43-2 of the flow channel-switching unit 40*a* may have the function of the flow rate-adjusting device 18.

In the above described third embodiment, an example in which the air-conditioning device 100*b* appropriately senses that one of the flow channel-switching unit 40, the temperature-detecting unit 51, the temperature-detecting unit 52, and a plurality of air blowers (the outdoor fan 19-1 and the outdoor fan 19-2) is erroneously installed is described above, but the present disclosure is not limited thereto. The air-conditioning device 100*b* may be able to sense that two or more of the flow channel-switching unit 40, the temperature-detecting unit 51, the temperature-detecting unit 52, and a plurality of air blowers (the outdoor fan 19-1 and the outdoor fan 19-2) are erroneously installed or to sense the temperature-detecting unit 51 and the temperature-detecting unit 52 are erroneously installed using a combination of four temperatures including the detected temperature T11, the detected temperature T12, the detected temperature T21, and the detected temperature T22 or magnitude relationships of temperature differences therebetween.

In the third embodiment, an example in which the air-conditioning device 100 (100*a*, 100*b*) switches between the cooling operation and the heating operation is described above, but the present disclosure is not limited thereto. The air-conditioning device 100 (100*a*, 100*b*) may have a circuit configuration for enabling a cooling/heating simultaneous operation, or the cooling/heating-switching unit 12 may be omitted and only the normal heating operation and the defrosting heating operation may be performed.

The aforementioned air-conditioning devices 100 (100*a* and 100*b*) include a computer system therein. The processing steps of the erroneous installation-sensing process are stored in a computer-readable recording medium in the form of a program, and the process is performed by causing the computer to read and execute the program. The computer-readable recording medium is a magnetic disk, a magnetooptical disc, a CD-ROM, a DVD-ROM, a semiconductor memory, or the like. This computer program may be transmitted to a computer via a communication line, and the computer receiving the program may execute the program.

The invention claimed is:

1. An air-conditioning device, comprising:

a main circuit in which a compressor, an indoor heat exchanger, a decompressor, and a plurality of parallel heat exchangers connected in parallel are connected by a pipe and in which a refrigerant circulates;

a flow channel-switching unit connected to the plurality of parallel heat exchangers and configured to select a certain parallel heat exchanger out of the plurality of parallel heat exchangers as a defrosting target for defrosting by melting frost attached to the parallel heat exchanger;

a bypass pipe configured to cause part of a refrigerant emitted from the compressor to flow into the parallel heat exchanger selected as the defrosting target by the flow channel-switching unit;

a temperature-detecting unit configured to detect temperatures of the refrigerant in the plurality of parallel heat exchangers; and at least one processor configured to operate the flow channel-switching unit such that an operation mode is switched between a normal heating operation mode in which the plurality of parallel heat exchangers serve as evaporators and a defrosting heating operation mode in which one parallel heat exchanger out of the plurality of parallel heat exchangers is selected as the defrosting target to cause part of the refrigerant to flow thereinto via the bypass pipe and the other parallel heat exchanger out of the plurality of parallel heat exchangers serves as an evaporator; and sense erroneous installation of an installed component associated with the defrosting based on a magnitude relationship between the detected temperatures in the plurality of parallel heat exchangers detected by the temperature-detecting unit.

2. The air-conditioning device according to claim 1, wherein the at least one processor is further configured to sense that the flow channel-switching unit or the temperature-detecting unit is erroneously installed when the detected temperature in the parallel heat exchanger serving as the defrosting target is equal to or lower than the detected temperature in the parallel heat exchanger serving as the evaporator in a state in which the operation mode is switched to the defrosting heating operation mode.

3. The air-conditioning device according to claim 1, further comprising a plurality of air blowers that blow air to the plurality of parallel heat exchangers, wherein the at least one processor is further configured to control the plurality of air blowers such that an airflow volume for the parallel heat exchanger serving as the defrosting target is smaller than an airflow volume for the parallel heat exchanger serving as the evaporator in the defrosting heating operation mode.

4. The air-conditioning device according to claim 3, wherein the at least one processor is further configured to sense erroneous installation of the plurality of air blowers based on a change of the detected temperature before and after the airflow volume of the air blower for one of the parallel heat exchanger serving as the defrosting target and the parallel heat exchanger serving as the evaporator is changed.

5. The air-conditioning device according to claim 4, wherein the at least one processor is further configured to sense that the plurality of air blowers are erroneously installed when the detected temperature after the airflow volume for the parallel heat exchanger serving as the defrosting target is increased is not lower than the detected temperature before the airflow volume is increased.

6. The air-conditioning device according to claim 3, wherein the temperature-detecting unit includes a first temperature-detecting unit and a second temperature-detecting unit, wherein the first temperature-detecting unit detects a saturation temperature of the refrigerant in each of the parallel heat exchangers as a first detected temperature, wherein the second temperature-detecting unit is disposed in a pipe connected to an opposite side to the bypass pipe of each of the parallel heat exchangers and detects a temperature of the refrigerant at an outlet of the parallel heat exchanger serving as the defrosting target as a second detected temperature, and wherein the at least one processor is further configured to determine whether one of the flow channel-switching unit, the first temperature-detecting unit, the second temperature-detecting unit, and the plurality of air blowers is erroneously installed based on a combination of the four detected temperatures including the first detected temperature and the second detected temperature in the parallel heat exchanger serving as the defrosting target and the first detected temperature and the second detected temperature in the parallel heat exchanger serving as the evaporator.

7. The air-conditioning device according to claim 1, wherein the at least one processor is further configured to cause a notification output unit to output notification information based on a result of sensing of erroneous installation of the installed component when erroneous installation of the installed component is sensed.

8. The air-conditioning device according to claim 1, wherein the at least one processor is further configured to, when a starting condition of sensing erroneous installation of the installed component is satisfied, sense erroneous installation of the installed component in a state in which the operation mode is switched to the defrosting heating operation mode.

9. The air-conditioning device according to claim 1, wherein the flow channel-switching unit comprises a plurality of on/off switching valves.

10. The air-conditioning device according to claim 1, wherein the temperature-detecting unit comprises one or more sensors that detect temperature or pressure.

11. The air-conditioning device according to claim 6, wherein the first temperature-detecting unit comprises at least one first sensor that detects temperature or pressure, and the second temperature-detecting unit comprises at least one second sensor that detects temperature or pressure.

12. The air-conditioning device according to claim 7, wherein the notification output unit comprises at least one of a display or a speaker or a notification lamp.

* * * * *